US008127782B2

(12) United States Patent
Jonte et al.

(10) Patent No.: US 8,127,782 B2
(45) **Date of Patent: *Mar. 6, 2012**

(54) MULTI-MODE HANDS FREE AUTOMATIC FAUCET

(76) Inventors: Patrick B. Jonte, Zionsville, IN (US); Robert W. Rodenbeck, Indianapolis, IN (US); David M. Burke, Taylor, MI (US); Garry R. Marty, Fishers, IN (US); Todd Huffington, Avon, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/518,842

(22) PCT Filed: Dec. 11, 2007

(86) PCT No.: PCT/US2007/025336

§ 371 (c)(1),
(2), (4) Date: Jun. 11, 2009

(87) PCT Pub. No.: WO2008/088534

PCT Pub. Date: Jul. 24, 2008

(65) Prior Publication Data

US 2010/0012194 A1 Jan. 21, 2010

(51) Int. Cl.
*F16K 31/02* (2006.01)
*G05D 7/06* (2006.01)

(52) U.S. Cl. ..... 137/1; 137/801; 251/129.04; 4/623

(58) Field of Classification Search ..... 137/1, 801, 137/613; 251/129.04; 4/623
See application file for complete search history.

(56) References Cited

U.S. PATENT DOCUMENTS

| | | | |
|---|---|---|---|
| 2,991,481 | A | 7/1961 | Book |
| 3,081,594 | A | 3/1963 | Atkins et al. |
| 3,151,340 | A | 10/1964 | Teshima |
| 3,254,313 | A | 5/1966 | Atkins et al. |
| 3,314,081 | A | 4/1967 | Atkins et al. |
| 3,333,160 | A | 7/1967 | Gorski |
| 3,406,941 | A | 10/1968 | Ichimori et al. |
| 3,588,038 | A | 6/1971 | Tanaka |
| 3,651,989 | A | 3/1972 | Westrich |
| 3,685,541 | A | 8/1972 | Braucksick et al. |
| 3,705,574 | A | 12/1972 | Duncan |
| 3,765,455 | A | 10/1973 | Countryman |
| 3,799,171 | A | 3/1974 | Patel |
| 3,987,819 | A | 10/1976 | Scheuermann |
| 4,185,336 | A | 1/1980 | Young |
| 4,201,518 | A | 5/1980 | Stevenson |
| 4,290,052 | A | 9/1981 | Eichelberger et al. |
| 4,295,132 | A | 10/1981 | Burney et al. |

(Continued)

FOREIGN PATENT DOCUMENTS

CA 2492226 A1 7/2005

(Continued)

OTHER PUBLICATIONS

Camacho et al., Freescale Semiconductor, "Touch Pad System Using MC34940/MC33794 E-Field Sensors," Feb. 2006, 52 pgs.

(Continued)

*Primary Examiner* — Kevin Lee
(74) *Attorney, Agent, or Firm* — Faegre Baker Daniels

(57) ABSTRACT

A hands-free faucet comprises a proximity sensor, a logical control, a handle, a spout, and a touch control operably coupled to at least one of the spout and the handle.

33 Claims, 18 Drawing Sheets

U.S. PATENT DOCUMENTS

| | | | |
|---|---|---|---|
| 4,331,292 | A | 5/1982 | Zimmer |
| 4,337,388 | A | 6/1982 | July |
| 4,359,186 | A | 11/1982 | Kiendl |
| 4,406,313 | A | 9/1983 | Bennett et al. |
| 4,407,444 | A | 10/1983 | Knebel et al. |
| 4,409,694 | A | 10/1983 | Barrett et al. |
| 4,410,791 | A | 10/1983 | Eastep |
| 4,420,811 | A | 12/1983 | Tarnay et al. |
| 4,421,269 | A | 12/1983 | Ts'ao |
| 4,424,767 | A | 1/1984 | Wicke et al. |
| 4,429,422 | A | 2/1984 | Wareham |
| 4,436,983 | A | 3/1984 | Solobay |
| 4,439,669 | A | 3/1984 | Ryffel |
| 4,450,829 | A | 5/1984 | Morita et al. |
| 4,459,465 | A | 7/1984 | Knight |
| 4,503,575 | A | 3/1985 | Knoop et al. |
| 4,537,348 | A | 8/1985 | Gossi |
| 4,541,562 | A | 9/1985 | Zukausky |
| 4,554,688 | A | 11/1985 | Puccerella |
| 4,563,780 | A | 1/1986 | Pollack |
| 4,567,350 | A | 1/1986 | Todd, Jr. |
| 4,581,707 | A | 4/1986 | Millar |
| 4,584,463 | A | 4/1986 | Klages et al. |
| 4,604,515 | A | 8/1986 | Davidson |
| 4,606,325 | A | 8/1986 | Lujan |
| 4,611,757 | A | 9/1986 | Saether |
| 4,628,902 | A | 12/1986 | Comber |
| 4,638,147 | A | 1/1987 | Dytch et al. |
| 4,674,678 | A | 6/1987 | Knebel et al. |
| 4,680,446 | A | 7/1987 | Post |
| 4,682,581 | A | 7/1987 | Laing et al. |
| 4,682,728 | A | 7/1987 | Oudenhoven et al. |
| 4,688,277 | A | 8/1987 | Kakinoki et al. |
| 4,700,884 | A | 10/1987 | Barrett et al. |
| 4,700,885 | A | 10/1987 | Knebel |
| 4,709,728 | A | 12/1987 | Ying-Chung |
| 4,713,525 | A | 12/1987 | Eastep |
| 4,716,605 | A | 1/1988 | Shepherd et al. |
| 4,735,357 | A | 4/1988 | Gregory et al. |
| 4,738,280 | A | 4/1988 | Oberholtzer |
| 4,742,456 | A | 5/1988 | Kamena |
| 4,750,472 | A | 6/1988 | Fazekas |
| 4,753,265 | A | 6/1988 | Barrett et al. |
| 4,756,030 | A | 7/1988 | Juliver |
| 4,757,943 | A | 7/1988 | Sperling et al. |
| 4,761,839 | A | 8/1988 | Ganaway |
| 4,762,273 | A | 8/1988 | Gregory et al. |
| 4,768,705 | A | 9/1988 | Tsutsui et al. |
| 4,786,782 | A | 11/1988 | Takai et al. |
| 4,798,224 | A | 1/1989 | Haws |
| 4,808,793 | A | 2/1989 | Hurko |
| 4,832,259 | A | 5/1989 | Vandermeyden |
| 4,845,316 | A | 7/1989 | Kaercher |
| 4,854,498 | A | 8/1989 | Stayton |
| 4,869,287 | A | 9/1989 | Pepper et al. |
| 4,869,427 | A | 9/1989 | Kawamoto et al. |
| 4,870,986 | A | 10/1989 | Barrett et al. |
| 4,872,485 | A | 10/1989 | Laverty |
| 4,875,623 | A | 10/1989 | Garris |
| 4,893,653 | A | 1/1990 | Ferrigno |
| 4,896,658 | A | 1/1990 | Yonekubo et al. |
| 4,901,915 | A | 2/1990 | Sakakibara |
| 4,909,435 | A | 3/1990 | Kidouchi et al. |
| 4,914,758 | A | 4/1990 | Shaw |
| 4,916,613 | A | 4/1990 | Lange et al. |
| 4,917,142 | A | 4/1990 | Laing et al. |
| 4,921,211 | A | 5/1990 | Novak et al. |
| 4,923,116 | A | 5/1990 | Homan |
| 4,930,551 | A | 6/1990 | Haws |
| 4,936,289 | A | 6/1990 | Peterson |
| 4,941,608 | A | 7/1990 | Shimizu et al. |
| 4,945,942 | A | 8/1990 | Lund |
| 4,945,943 | A | 8/1990 | Cogger |
| 4,955,535 | A | 9/1990 | Tsutsui et al. |
| 4,965,894 | A | 10/1990 | Baus |
| 4,967,794 | A | 11/1990 | Tsutsui et al. |
| 4,969,598 | A | 11/1990 | Garris |
| 4,970,373 | A | 11/1990 | Lutz et al. |
| 4,971,106 | A | 11/1990 | Tsutsui et al. |
| 4,981,158 | A | 1/1991 | Brondolino et al. |
| 4,985,944 | A | 1/1991 | Shaw |
| 4,995,585 | A | 2/1991 | Gruber et al. |
| 4,998,673 | A | 3/1991 | Pilolla |
| 5,009,572 | A | 4/1991 | Imhoff et al. |
| 5,012,124 | A | 4/1991 | Hollaway |
| 5,020,127 | A | 5/1991 | Eddas et al. |
| 5,033,508 | A | 7/1991 | Laverty |
| 5,033,715 | A | 7/1991 | Chiang |
| 5,040,106 | A | 8/1991 | Maag |
| 5,042,524 | A | 8/1991 | Lund |
| 5,056,712 | A | 10/1991 | Enck |
| 5,057,214 | A | 10/1991 | Morris |
| 5,058,804 | A | 10/1991 | Yonekubo et al. |
| 5,063,955 | A | 11/1991 | Sakakibara |
| 5,073,991 | A | 12/1991 | Marty |
| 5,074,520 | A | 12/1991 | Lee et al. |
| 5,086,526 | A | 2/1992 | Van Marcke |
| 5,092,560 | A | 3/1992 | Chen |
| 5,095,945 | A | 3/1992 | Jensen |
| 5,105,846 | A | 4/1992 | Britt |
| 5,124,934 | A | 6/1992 | Kawamoto et al. |
| 5,125,433 | A | 6/1992 | DeMoss et al. |
| 5,129,034 | A | 7/1992 | Sydenstricker |
| 5,133,089 | A | 7/1992 | Tsutsui et al. |
| 5,139,044 | A | 8/1992 | Otten et al. |
| 5,143,049 | A | 9/1992 | Laing et al. |
| 5,148,824 | A | 9/1992 | Wilson et al. |
| 5,170,361 | A | 12/1992 | Reed |
| 5,170,514 | A | 12/1992 | Weigert |
| 5,170,816 | A | 12/1992 | Schnieders |
| 5,170,944 | A | 12/1992 | Shirai |
| 5,174,495 | A | 12/1992 | Eichholz et al. |
| 5,175,892 | A | 1/1993 | Shaw |
| 5,183,029 | A | 2/1993 | Ranger |
| 5,184,642 | A | 2/1993 | Powell |
| 5,187,816 | A | 2/1993 | Chiou |
| 5,202,666 | A | 4/1993 | Knippscheer |
| 5,205,318 | A | 4/1993 | Massaro et al. |
| 5,206,963 | A | 5/1993 | Wiens |
| 5,217,035 | A | 6/1993 | Van Marcke |
| 5,224,509 | A | 7/1993 | Tanaka et al. |
| 5,224,685 | A | 7/1993 | Chiang et al. |
| 5,243,717 | A | 9/1993 | Yasuo |
| D340,279 | S | 10/1993 | Mattis |
| 5,257,341 | A | 10/1993 | Austin et al. |
| 5,261,443 | A | 11/1993 | Walsh |
| 5,262,621 | A | 11/1993 | Hu et al. |
| 5,265,318 | A | 11/1993 | Shero |
| 5,277,219 | A | 1/1994 | Lund |
| 5,281,808 | A | 1/1994 | Kunkel |
| 5,287,570 | A | 2/1994 | Peterson et al. |
| 5,309,940 | A | 5/1994 | Delabie et al. |
| 5,315,719 | A | 5/1994 | Tsutsui et al. |
| 5,322,086 | A | 6/1994 | Sullivan |
| 5,323,803 | A | 6/1994 | Blumenauer |
| 5,325,822 | A | 7/1994 | Fernandez |
| 5,334,819 | A | 8/1994 | Lin |
| 5,341,839 | A | 8/1994 | Kobayashi et al. |
| 5,351,347 | A | 10/1994 | Kunkel |
| 5,351,712 | A | 10/1994 | Houlihan |
| 5,358,177 | A | 10/1994 | Cashmore |
| 5,361,215 | A | 11/1994 | Tompkins et al. |
| 5,362,026 | A | 11/1994 | Kobayashi et al. |
| 5,385,168 | A | 1/1995 | Lund |
| 5,397,099 | A | 3/1995 | Pilolla |
| 5,400,961 | A | 3/1995 | Tsutsui et al. |
| 5,408,578 | A | 4/1995 | Bolivar |
| 5,419,930 | A | 5/1995 | Schucker |
| 5,429,272 | A | 7/1995 | Luigi |
| 5,437,003 | A | 7/1995 | Blanco |
| RE35,018 | E | 8/1995 | Homan |
| 5,438,642 | A | 8/1995 | Posen |
| 5,467,967 | A | 11/1995 | Gillooly |
| 5,479,558 | A | 12/1995 | White et al. |
| 5,482,250 | A | 1/1996 | Kodaira |
| 5,504,306 | A | 4/1996 | Russell et al. |
| 5,504,950 | A | 4/1996 | Natalizia et al. |

5,511,579 A 4/1996 Price
5,511,723 A 4/1996 Eki et al.
5,540,555 A 7/1996 Corso et al.
5,549,273 A 8/1996 Aharon
5,550,753 A 8/1996 Tompkins et al.
5,551,637 A 9/1996 Lo
5,555,912 A 9/1996 Saadi et al.
5,564,462 A 10/1996 Storch
5,566,702 A 10/1996 Philipp
5,570,869 A 11/1996 Diaz et al.
5,572,985 A 11/1996 Benham
5,577,660 A 11/1996 Hansen
5,584,316 A 12/1996 Lund
5,586,572 A 12/1996 Lund
5,588,636 A 12/1996 Eichholz et al.
5,595,216 A 1/1997 Pilolla
5,595,342 A 1/1997 McNair et al.
5,603,344 A 2/1997 Hall
5,609,370 A 3/1997 Szabo et al.
5,610,589 A 3/1997 Evans et al.
5,622,203 A 4/1997 Givler et al.
5,623,990 A 4/1997 Pirkle
5,627,375 A 5/1997 Hsieh
5,650,597 A 7/1997 Redmayne
5,651,384 A 7/1997 Rudrich
5,655,749 A 8/1997 Mauerhofer
5,682,032 A 10/1997 Philipp
5,694,653 A 12/1997 Harald
5,729,422 A 3/1998 Henke
5,730,165 A 3/1998 Philipp
5,735,291 A 4/1998 Kaonohi
5,743,511 A 4/1998 Eichholz et al.
5,755,262 A 5/1998 Pilolla
5,758,688 A 6/1998 Hamanaka et al.
5,758,690 A 6/1998 Humpert et al.
5,769,120 A 6/1998 Laverty et al.
5,771,501 A 6/1998 Shaw
5,775,372 A 7/1998 Houlihan
5,784,531 A 7/1998 Mann et al.
5,790,024 A 8/1998 Ripingill et al.
5,812,059 A 9/1998 Shaw et al.
5,813,655 A 9/1998 Pinchott et al.
5,819,366 A 10/1998 Edin
5,829,467 A 11/1998 Spicher
5,829,475 A 11/1998 Acker
5,845,844 A 12/1998 Zosimodis
5,855,356 A 1/1999 Fait
5,857,717 A 1/1999 Caffrey
5,868,311 A 2/1999 Cretu-Petra
5,872,891 A 2/1999 Son
5,893,387 A 4/1999 Paterson et al.
5,915,417 A 6/1999 Diaz et al.
5,918,855 A 7/1999 Hamanaka et al.
5,934,325 A 8/1999 Brattoli et al.
5,941,275 A 8/1999 Laing
5,941,504 A 8/1999 Toma et al.
5,943,713 A 8/1999 Paterson et al.
5,944,221 A 8/1999 Laing et al.
5,961,095 A 10/1999 Schrott
5,963,624 A 10/1999 Pope
5,966,753 A 10/1999 Gauthier et al.
5,973,417 A 10/1999 Goetz et al.
5,979,776 A 11/1999 Williams
5,983,922 A 11/1999 Laing et al.
5,988,593 A 11/1999 Rice
6,000,170 A 12/1999 Davis
6,003,170 A 12/1999 Humpert et al.
6,003,182 A 12/1999 Song
6,006,784 A 12/1999 Tsutsui et al.
6,019,130 A 2/2000 Rump
6,026,844 A 2/2000 Laing et al.
6,029,094 A 2/2000 Diffut
6,032,616 A 3/2000 Jones
6,042,885 A 3/2000 Woollard et al.
6,059,192 A 5/2000 Zosimadis
6,061,499 A 5/2000 Hlebovy
6,075,454 A 6/2000 Yamasaki
6,082,407 A 7/2000 Paterson et al.
6,101,452 A 8/2000 Krall et al.
6,125,482 A 10/2000 Foster
6,132,085 A 10/2000 Bergeron
6,167,845 B1 1/2001 Decker, Sr.
6,175,689 B1 1/2001 Blanco, Jr.
6,182,683 B1 2/2001 Sisk
6,192,192 B1 2/2001 Illy et al.
6,195,588 B1 2/2001 Gauthier et al.
6,202,980 B1 3/2001 Vincent et al.
6,220,297 B1 4/2001 Marty et al.
6,227,235 B1 5/2001 Laing et al.
6,240,250 B1 5/2001 Blanco, Jr.
6,250,558 B1 6/2001 Dogre Cuevas
6,250,601 B1 6/2001 Kolar et al.
6,273,394 B1 8/2001 Vincent et al.
6,283,139 B1 9/2001 Symonds et al.
6,286,764 B1 9/2001 Garvey et al.
6,288,707 B1 9/2001 Philipp
6,290,139 B1 9/2001 Kolze
6,294,786 B1 9/2001 Marcichow et al.
6,315,208 B1 11/2001 Doyle
6,317,717 B1 11/2001 Lindsey et al.
6,321,785 B1 11/2001 Bergmann
6,337,635 B1 1/2002 Ericksen et al.
6,340,032 B1 1/2002 Zosimadis
6,341,389 B2 1/2002 Philipps-Liebich et al.
6,351,603 B2 2/2002 Waithe et al.
6,363,549 B2 4/2002 Humpert
6,373,265 B1 4/2002 Morimoto et al.
6,377,009 B1 4/2002 Philipp
6,381,770 B1 5/2002 Raisch
6,389,226 B1 5/2002 Neale et al.
6,438,770 B1 8/2002 Hed et al.
6,445,306 B1 9/2002 Trovato et al.
6,446,875 B1 9/2002 Brooks et al.
6,452,514 B1 9/2002 Philipp
RE37,888 E 10/2002 Cretu-Petra
6,457,355 B1 10/2002 Philipp
6,466,036 B1 10/2002 Philipp
6,473,917 B1 11/2002 Mateina
6,474,951 B2 11/2002 Stephan et al.
6,513,787 B1 2/2003 Jeromson et al.
6,522,078 B1 2/2003 Okamoto et al.
6,535,134 B2 3/2003 Lang et al.
6,535,200 B2 3/2003 Philipp
6,536,464 B1 3/2003 Lum et al.
6,549,816 B2 4/2003 Gauthier et al.
6,574,426 B1 6/2003 Blanco, Jr.
6,588,377 B1 7/2003 Leary et al.
6,588,453 B2 7/2003 Marty et al.
6,612,267 B1 9/2003 West
6,619,320 B2 9/2003 Parsons
6,622,930 B2 9/2003 Laing et al.
6,629,645 B2 10/2003 Mountford et al.
6,639,209 B1 10/2003 Patterson et al.
6,644,333 B2 11/2003 Gloodt
6,659,048 B1 12/2003 DeSantis et al.
6,676,024 B1 1/2004 McNerney et al.
6,684,822 B1 2/2004 Lieggi
6,691,338 B2 2/2004 Zieger
6,705,534 B1 3/2004 Mueller
6,707,030 B1 3/2004 Watson
6,734,685 B2 5/2004 Rudrich
6,738,996 B1 5/2004 Malek et al.
6,757,921 B2 7/2004 Esche
6,768,103 B2 7/2004 Watson
6,770,869 B2 8/2004 Patterson et al.
6,779,552 B1 8/2004 Coffman
6,838,887 B2 1/2005 Denen et al.
6,845,526 B2 1/2005 Malek et al.
6,877,172 B2 4/2005 Malek et al.
6,892,952 B2 5/2005 Chang et al.
6,895,985 B2 5/2005 Popper et al.
6,913,203 B2 7/2005 DeLangis
6,955,333 B2 10/2005 Patterson et al.
6,956,498 B1 10/2005 Gauthier et al.
6,962,162 B2 11/2005 Acker
6,962,168 B2 * 11/2005 McDaniel et al. ..... 137/624.12
6,964,404 B2 11/2005 Patterson et al.
6,964,405 B2 11/2005 Marcichow et al.

| | | | |
|---|---|---|---|
| 6,968,860 | B1 | 11/2005 | Haenlein et al. |
| 6,993,607 | B2 | 1/2006 | Philipp |
| 6,995,670 | B2 | 2/2006 | Wadlow et al. |
| 6,998,545 | B2 | 2/2006 | Harkcom et al. |
| 7,006,078 | B2 | 2/2006 | Kim |
| 7,014,166 | B1 | 3/2006 | Wang |
| 7,015,704 | B1 | 3/2006 | Lang |
| 7,025,077 | B2 | 4/2006 | Vogel |
| 7,030,860 | B1 | 4/2006 | Hsu et al. |
| 7,069,357 | B2 | 6/2006 | Marx et al. |
| 7,069,941 | B2 | 7/2006 | Parsons et al. |
| 7,083,156 | B2 | 8/2006 | Jost et al. |
| 7,096,517 | B2 | 8/2006 | Gubeli et al. |
| 7,099,649 | B2 | 8/2006 | Patterson et al. |
| D528,991 | S | 9/2006 | Katsuyama |
| 7,102,366 | B2 | 9/2006 | Denen et al. |
| 7,107,631 | B2 | 9/2006 | Lang et al. |
| 7,150,293 | B2 | 12/2006 | Jonte |
| 7,174,577 | B2 | 2/2007 | Jost et al. |
| 7,174,579 | B1 | 2/2007 | Bauza |
| 7,232,111 | B2 | 6/2007 | McDaniels et al. |
| 7,278,624 | B2 | 10/2007 | Iott et al. |
| 7,307,485 | B1 | 12/2007 | Snyder et al. |
| 7,537,023 | B2 | 5/2009 | Marty et al. |
| 7,537,195 | B2 | 5/2009 | McDaniels et al. |
| 7,690,395 | B2 | 4/2010 | Jonte et al. |
| 7,766,026 | B2 * | 8/2010 | Boey ..... 4/623 |
| 7,784,481 | B2 * | 8/2010 | Kunkel ..... 251/129.04 |
| 2001/0011389 | A1 | 8/2001 | Philipps-Liebich et al. |
| 2001/0011390 | A1 | 8/2001 | Humpert et al. |
| 2001/0011558 | A1 | 8/2001 | Schumacher |
| 2001/0011560 | A1 | 8/2001 | Pawelzik et al. |
| 2001/0022352 | A1 | 9/2001 | Rudrich |
| 2002/0007510 | A1 | 1/2002 | Mann |
| 2002/0015024 | A1 | 2/2002 | Westerman et al. |
| 2002/0113134 | A1 | 8/2002 | Laing et al. |
| 2002/0117122 | A1 | 8/2002 | Lindner |
| 2002/0148040 | A1 | 10/2002 | Mateina |
| 2002/0175789 | A1 | 11/2002 | Pimouguet |
| 2002/0179723 | A1 | 12/2002 | Wack et al. |
| 2003/0041374 | A1 | 3/2003 | Franke |
| 2003/0080194 | A1 | 5/2003 | O'Hara et al. |
| 2003/0088338 | A1 | 5/2003 | Phillips et al. |
| 2003/0089399 | A1 | 5/2003 | Acker |
| 2003/0125842 | A1 | 7/2003 | Chang et al. |
| 2003/0126993 | A1 | 7/2003 | Lassota et al. |
| 2003/0185548 | A1 | 10/2003 | Novotny et al. |
| 2003/0201018 | A1 | 10/2003 | Bush |
| 2003/0213062 | A1 | 11/2003 | Honda et al. |
| 2003/0234769 | A1 | 12/2003 | Cross et al. |
| 2004/0011399 | A1 | 1/2004 | Segien, Jr. |
| 2004/0041033 | A1 | 3/2004 | Kemp |
| 2004/0041034 | A1 | 3/2004 | Kemp |
| 2004/0041110 | A1 | 3/2004 | Kaneko |
| 2004/0061685 | A1 | 4/2004 | Ostergard et al. |
| 2004/0088786 | A1 | 5/2004 | Malek et al. |
| 2004/0135010 | A1 | 7/2004 | Malek et al. |
| 2004/0143898 | A1 | 7/2004 | Jost et al. |
| 2004/0144866 | A1 | 7/2004 | Nelson et al. |
| 2004/0149643 | A1 | 8/2004 | Vandenbelt et al. |
| 2004/0155116 | A1 | 8/2004 | Wack et al. |
| 2004/0206405 | A1 | 10/2004 | Smith et al. |
| 2004/0212599 | A1 | 10/2004 | Cok et al. |
| 2004/0262552 | A1 | 12/2004 | Lowe |
| 2005/0001046 | A1 | 1/2005 | Laing |
| 2005/0006402 | A1 | 1/2005 | Acker |
| 2005/0022871 | A1 | 2/2005 | Acker |
| 2005/0044625 | A1 | 3/2005 | Kommers |
| 2005/0086958 | A1 | 4/2005 | Walsh |
| 2005/0117912 | A1 | 6/2005 | Patterson et al. |
| 2005/0121529 | A1 | 6/2005 | DeLangis |
| 2005/0125083 | A1 | 6/2005 | Kiko |
| 2005/0127313 | A1 | 6/2005 | Watson |
| 2005/0146513 | A1 | 7/2005 | Hill et al. |
| 2005/0150552 | A1 | 7/2005 | Forshey |
| 2005/0150556 | A1 | 7/2005 | Jonte |
| 2005/0150557 | A1 | 7/2005 | McDaniel et al. |
| 2005/0151101 | A1 | 7/2005 | McDaniel et al. |
| 2005/0194399 | A1 | 9/2005 | Proctor |
| 2005/0199841 | A1 | 9/2005 | O'Maley |
| 2005/0199843 | A1 | 9/2005 | Jost et al. |
| 2005/0205818 | A1 | 9/2005 | Bayley et al. |
| 2005/0253102 | A1 | 11/2005 | Boilen et al. |
| 2005/0273218 | A1 | 12/2005 | Breed et al. |
| 2006/0066991 | A1 | 3/2006 | Hirano et al. |
| 2006/0101575 | A1 | 5/2006 | Louis |
| 2006/0130907 | A1 | 6/2006 | Marty et al. |
| 2006/0130908 | A1 | 6/2006 | Marty et al. |
| 2006/0138246 | A1 | 6/2006 | Stowe et al. |
| 2006/0145111 | A1 | 7/2006 | Lang et al. |
| 2006/0153165 | A1 | 7/2006 | Beachy |
| 2006/0186215 | A1 | 8/2006 | Logan |
| 2006/0200903 | A1 | 9/2006 | Rodenbeck et al. |
| 2006/0201558 | A1 | 9/2006 | Marty et al. |
| 2006/0202142 | A1 | 9/2006 | Marty et al. |
| 2006/0207019 | A1 | 9/2006 | Vincent |
| 2006/0212016 | A1 | 9/2006 | Lavon et al. |
| 2006/0214016 | A1 | 9/2006 | Erdely et al. |
| 2006/0231638 | A1 | 10/2006 | Belz et al. |
| 2006/0231782 | A1 | 10/2006 | Iott et al. |
| 2006/0231788 | A1 | 10/2006 | Cheng |
| 2006/0237674 | A1 | 10/2006 | Iott et al. |
| 2006/0283511 | A1 | 12/2006 | Nelson |
| 2007/0001018 | A1 | 1/2007 | Schmitt et al. |
| 2007/0057215 | A1 | 3/2007 | Parsons et al. |
| 2007/0069168 | A1 | 3/2007 | Jonte |
| 2007/0069169 | A1 | 3/2007 | Lin |
| 2007/0114073 | A1 | 5/2007 | Akel et al. |
| 2007/0138421 | A1 | 6/2007 | Gibson et al. |
| 2007/0156260 | A1 | 7/2007 | Rodenbeck et al. |
| 2007/0157978 | A1 | 7/2007 | Jonte |
| 2007/0187635 | A1 | 8/2007 | Jost |
| 2007/0246267 | A1 | 10/2007 | Koottungal |
| 2007/0246550 | A1 | 10/2007 | Rodenbeck et al. |
| 2007/0246564 | A1 | 10/2007 | Rodenbeck et al. |
| 2008/0078019 | A1 | 4/2008 | Allen et al. |
| 2008/0099088 | A1 | 5/2008 | Boey |
| 2008/0109956 | A1 | 5/2008 | Bayley et al. |
| 2008/0178950 | A1 | 7/2008 | Marty et al. |
| 2008/0271238 | A1 | 11/2008 | Reeder et al. |
| 2008/0289098 | A1 | 11/2008 | Kunkel |
| 2009/0039176 | A1 | 2/2009 | Davidson et al. |
| 2009/0119832 | A1 | 5/2009 | Conroy |
| 2009/0160659 | A1 | 6/2009 | Bailey |
| 2009/0293192 | A1 | 12/2009 | Pons |
| 2010/0044604 | A1 | 2/2010 | Burke et al. |
| 2010/0096017 | A1 | 4/2010 | Jonte et al. |
| 2010/0108165 | A1 | 5/2010 | Rodenbeck et al. |
| 2010/0170570 | A1 | 7/2010 | Rodenbeck et al. |

FOREIGN PATENT DOCUMENTS

| | | | |
|---|---|---|---|
| DE | 3339849 | | 5/1985 |
| DE | 04401637 | | 5/1998 |
| DE | 19815324 | | 11/2000 |
| EP | 0961067 | B1 | 12/1999 |
| EP | 1 134 895 | | 9/2001 |
| JP | 63111383 | | 5/1998 |
| JP | 200073426 | | 3/2000 |
| JP | 2003-20703 | A | 1/2003 |
| JP | 2003105817 | | 4/2003 |
| JP | 2003293411 | | 10/2003 |
| JP | 2004-92023 | | 3/2004 |
| JP | 2005-146551 | A | 6/2005 |
| KR | 10-1997-0700266 | | 1/1997 |
| KR | 2003-0077823 | | 10/2003 |
| KR | 20-0382786 | Y1 | 4/2005 |
| WO | WO 91/17377 | | 11/1991 |
| WO | WO 96 14477 | | 5/1996 |
| WO | WO 01/20204 | | 3/2001 |
| WO | WO2004/094990 | | 11/2004 |
| WO | WO 2005/057086 | | 6/2005 |
| WO | WO 2006/098795 | | 9/2006 |
| WO | WO 2006/136256 | | 12/2006 |
| WO | WO 2007/059051 | | 5/2007 |
| WO | WO 2007/124311 | | 11/2007 |
| WO | WO 2007/124438 | | 11/2007 |
| WO | WO 2008/088534 | | 7/2008 |
| WO | WO 2008/094247 | | 8/2008 |

| | | |
|---|---|---|
| WO | WO 2008/094651 | 8/2008 |
| WO | WO 2008/118402 | 10/2008 |
| WO | WO 2009/075858 | 6/2009 |

OTHER PUBLICATIONS

Dallmer Manutronic brochure, "The First Electronic mixer-taps that your hands can orchestrate," Dallmer Handel GmbH, at least as early as Jan. 31, 2008, 12 pgs.
International Search Report and Written Opinion for PCT/US2007/025336, 5 pages.
International Search Report and Written Opinion for PCT/US2008/67116, 9 pages.
KWC AG, Kitchen Faucet 802285 Installation and Service Instructions, dated Jul. 2005, 8 pgs.
Philipp, Hal, "Tough Touch Screen," applicanceDESIGN, Feb. 2006.
Quantum Research Group, "Gorenje Puts QSlide™ Technology into Next-Generation Kitchen Hob," Feb. 8, 2006, http://www.qprox.com/news/gorenje.php, 3 pgs.
Quantum Research Group, "QT401 QSlide™ Touch Slider IC," 2004, 16 pgs.
Quantum Research Group, "QT411-ISSG QSlide™ Touch Slider IC," 2004-2005, 12 pgs.
Sequine et al., Cypress Perform, "Application Notes AN2292," Oct. 31, 2005, 15 pgs.
Sequine et al., Cypress Perform, "Application Notes AN2233a," Apr. 14, 2005, 6 pgs.
Symmons, Ultra-Sense, Battery-Powered Faucets with PDS and Ultra-Sense AC Powered Faucets, © 1999-2004, 2 pgs.
Various Products (available at least before Apr. 20, 2006), 5 pgs.
Villeroy & Boch web pages, "Magic Basin," 2 pgs., downloaded from http://www.villeroy-boch.com on Dec. 27, 2006.
TOTO® Products, "Self-Generating EcoPower System Sensor Faucet, Standard Spout," Specification Sheet, Nov. 2002, 2 pgs.
ZURN® Plumbing Products Group, "AquaSense® Z6903 Series", Installation, Operation, Maintenance and Parts Manual, Aug. 2001, 5 pgs.
ZURN® Plumbing Products Group, "AquaSense® Sensor Faucet," Jun. 9, 2004, 2 pgs.
SLOAN® Optima® i.q. Electronic Hand Washing Faucet, Apr. 2004, 2 pgs.
Symmons®, "Ultra-Sense® Battery-Powered, Sensor-Operated Lavatory Faucet S-6080 Series," Oct. 2002, 4 pgs.
Symmons®, "Ultra-Sense® Sensor Faucets with Position-Sensitive Detection," Aug. 2004, 4 pgs.
Symmons®, "Ultra-Sense® Sensor Faucet with Position-Sensitive Detection," ©2001-2002, 2 pgs.
Technical Concepts, AutoFaucet® with "Surround Sensor" Technology, Oct. 2005, 4 pgs.
Hego WaterDesign, "Touch Faucets—Amazing Futuristic Faucet Designs," Oct. 6, 2009, 3 pgs.
Quantum Research Group, "E401 User Manual," at least as early as Oct. 22, 2007, 15 pgs.
Quantum Research Group, "Qprox™ Capacitive Touch Applications," © 2005, http://www.qprox.com/background/applications.php, 8 pgs.
Symmons® Commercial Faucets: Reliability With a Sense of Style, at least as early as Jan. 4, 2006, 1 pg.
Technical Concepts International, Inc., Capri AutoFaucet® with Surround Sensor™ Technology, 500556, 500576, 500577, at least as early as May 1, 2006, 1 pg.
Villeroy & Boch "Magic Faucet," at least as early as Nov. 2009, 2 pgs.

* cited by examiner

MULTI-MODE HANDS FREE AUTOMATIC FAUCET

CROSS-REFERENCE TO RELATED APPLICATION

This application is a national phase filing of PCT International Application Ser. No. PCT/US2007/025336, filed Dec. 11, 2007, which claims the benefit of U.S. patent application Ser. No. 11/641,574, filed Dec. 19, 2006 now U.S. Pat. No. 7,690,395, the disclosures of which are expressly incorporated herein by reference.

BACKGROUND OF THE INVENTION

1. Field of the Invention

The present invention generally relates to the field of automatic faucets. More particularly, the present invention relates to an automatic faucet that uses both proximity and contact sensors in conjunction with logic that responds to various actions to provide easy and intuitive operation.

2. Description of the Related Art

Automatic faucets have become popular for a variety of reasons. They save water, because water can be run only when needed. For example, with a conventional sink faucet, when a user washes their hands the user tends to turn on the water and let it run continuously, rather than turning the water on to wet their hands, turning it off to lather, then turning it back on to rinse. In public bathrooms the ability to shut off the water when the user has departed can both save water and help prevent vandalism.

One early version of an automatic faucet was simply a spring-controlled faucet, which returned to the "off" position either immediately, or shortly after, the handle was released. The former were unsatisfactory because a user could only wash one hand at a time, while the later proved to be mechanically unreliable.

A better solution was hands-free faucets. These faucets employ a proximity detector and an electric power source to activate water flow, and so can be operated without a handle. In addition to helping to conserve water and prevent vandalism, hands-free faucets also had additional advantages, some of which began to make them popular in homes, as well as public bathrooms. For example, there is no need to touch the faucet to activate it; with a conventional faucet, a user with dirty hands may need to wash the faucet after washing their hands. Non-contact operation is also more sanitary, especially in public facilities. Hands-free faucets also provide superior accessibility for the disabled, or for the elderly, or those who need assisted care.

Typically, these faucets use proximity detectors, such as active infrared ("IR") detectors in the form of photodiode pairs, to detect the user's hands (or other objects positioned in the sink for washing). Pulses of IR light are emitted by one diode with the other being used to detect reflections of the emitted light off an object in front of the faucet. Different designs use different locations on the spout for the photodiodes, including placing them at the head of the spout, farther down the spout near its base, or even at positions entirely separate from the spout. Likewise, different designs use different physical mechanisms for detecting the proximity of objects, such as ultrasonic signals or changes in the magnetic permeability near the faucet.

Examples of a hands-free faucets are given in U.S. Pat. No. 5,566,702 to Philippe, and U.S. Pat. No. 6,273,394 to Vincent, and U.S. Pat. No. 6,363,549 to Humpert, which are hereby incorporated herein in their entireties.

Although hands-free faucets have many advantages, depending on how they are used, some tasks may best be accomplished with direct control over the starting and stopping of the flow of water. For example, if the user wishes to fill the basin with water to wash something the hands-free faucet could be frustrating, since it would require the user to keep their hand continuously in the detection zone of the sensors. This is especially likely with a kitchen sink faucet, which may be used in many different tasks, such as washing dishes and utensils. Due to its size, the kitchen sink is often the preferred sink for filling buckets, pots, etc. Thus, there is a need for a kitchen faucet that provides water savings, but which does not interfere with other tasks in which a continuous flow is desired.

Each of these control methods has advantages for a particular intended task. Thus, what is needed is a faucet that provides both conventional, touch control, and hands-free operation modes, so that a user can employ the control mode that is best suited to the task at hand. The present invention is directed towards meeting this need, among others.

SUMMARY OF THE INVENTION

In an illustrative embodiment, the present invention provides a hands-free faucet comprising a proximity sensor, a handle, and a logical control. The logical control comprises a manual mode, wherein the proximity sensor is inactive, and wherein positioning the handle toggles water flow on and off. This logical control also comprises a hands-free mode, wherein water flow is toggled on and off in response to the proximity sensor. The mode-controller toggles the faucet between the hands-free mode and the manual mode. The handle comprises a touch control, the touch control controlling activation of water flow through the faucet in response to contact of a user with the handle that is insufficient to change a position of the handle.

In a further illustrative embodiment, the present invention provides a hands-free faucet comprising a proximity sensor and a logical control. The logical control comprises a manual mode, wherein the proximity sensor is inactive, and water flow is toggled on and off by positioning the handle; a hands-free mode, wherein water flow is toggled on and off in response to the proximity sensor; and a handle. The handle comprises a first touch control that puts the faucet in the hands-free mode when touched by a user; a second touch control that toggles the faucet between the hands-free mode and the manual mode when touched by a user; and a mode indicator that displays which mode the faucet is presently in. The water flow has a temperature and flow rate that is determined by the position of the handle.

In another illustrative embodiment, the present invention provides a hands-free kitchen-type faucet.

In a further illustrative embodiment, the present invention provides a kitchen-type faucet having a touch control that controls activation of water flow through the faucet in response to contact of a user with a handle, where the contact is insufficient to change a position of the handle.

In yet another illustrative embodiment, the present invention provides a hands-free faucet comprising a manual valve; an electrically operable valve in series with the manual valve; and a logical control comprising a manual mode and a hands-free mode, the logical control causing the electrically operable valve to open and close. The faucet enters the manual mode when the faucet detects that water is not flowing through the faucet and the electrically operable valve is open.

In a further illustrative embodiment, the present invention provides a faucet comprising a pull-down spout, wherein pulling out the pull-down spout activates water flow.

In another illustrative embodiment, a faucet includes a spout, a handle, and a touch control operably coupled to at least one of the spout and the handle. A proximity sensor is provided and includes an active and an inactive state. A logical control is operably coupled to the touch control and the proximity sensor. The logical control includes a first mode, wherein the proximity sensor is inactive, and a second mode, wherein the proximity sensor is active. A mode indicator is configured to provide a visual indication of at least one of the first mode and the second mode.

According to a further illustrative embodiment, a faucet includes a spout, a handle, and a touch control operably coupled to at least one of the spout and the handle. A proximity sensor is provided and includes an active state and an inactive state. A logical control is operably coupled to the touch control and the proximity sensor. The logical control includes a first mode, wherein the proximity sensor is inactive, and a second mode, wherein the proximity sensor is active. The logical control further includes a mode controller that changes the faucet between the first mode and the second mode and responds to substantially simultaneous touching of the spout and the handle.

In a further illustrative embodiment, a faucet includes a spout, a handle, a touch control operably coupled to at least one of the spout and the handle, and a proximity sensor having an active state and an inactive state. A logical control is operably coupled to the touch control and the proximity sensor. The logical control includes a first mode, wherein the proximity sensor is inactive, and a second mode wherein the proximity sensor is active. An audio device is configured to provide an audible indication of transition between the first mode and the second mode.

In another embodiment of the present invention, a capacitive sensor is provided for use with a single hole mount faucet. In single hole mount faucets, the spout and manual valve handle are coupled to a faucet body hub which is connected to a single mounting hole. The capacitive sensor may be either coupled to a new faucet or retrofit onto an existing faucet without impacting the industrial design or requiring redesign of the faucet.

In an illustrated embodiment, a capacitive sensor is electrically connected to the faucet body hub. The handle of the manual control valve is electrically coupled to the faucet body hub due to metal-to-metal contact between the handle and the hub. However, the spout is coupled to the faucet body hub with an insulator or impedance coupling. Therefore, the spout is capacitively coupled to the faucet body hub. A larger capacitance difference is detected when the handle is grasped by a user compared to when the spout is grasped. Therefore, a controller can determine where a user is touching the faucet (i.e., the handle or the spout), and for how long, in order to control operation of the faucet in different modes. In a further illustrative embodiment, the handle of the manual control valve is capacitively coupled to the hub through the use of an insulator.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying figures forming a part hereof.

DETAILED DESCRIPTION OF THE PREFERRED EMBODIMENT

For the purposes of promoting an understanding of the principles of the invention, reference will now be made to the preferred embodiment and specific language will be used to describe the same. It will nevertheless be understood that no limitation of the scope of the invention is thereby intended. Such alternations and further modifications in the invention, and such further applications of the principles of the invention as described herein as would normally occur to one skilled in the art to which the invention pertains, are contemplated, and desired to be protected.

An illustrative embodiment of the present invention provides a kitchen-type faucet that can be placed in at least two modes, in order to provide water-efficient operation that is easy and convenient to use. In a hands-free mode, the water is activated and deactivated in response to a proximity sensor that detects when something is presently under the spout, so as to provide the most water-efficient operation, while still maintaining easy and convenient operation and use. For other applications, such as filling the sink to wash dishes, or filling pots, bottles, or other such items, the faucet can be operated in manual mode, wherein the water is controlled by a manual handle as with a conventional faucet. When the faucet is manually closed and not in use, the faucet is returned to manual mode, and the proximity detector is deactivated, so that power consumption is limited, making it practical to power the faucet with batteries.

Figure 1:
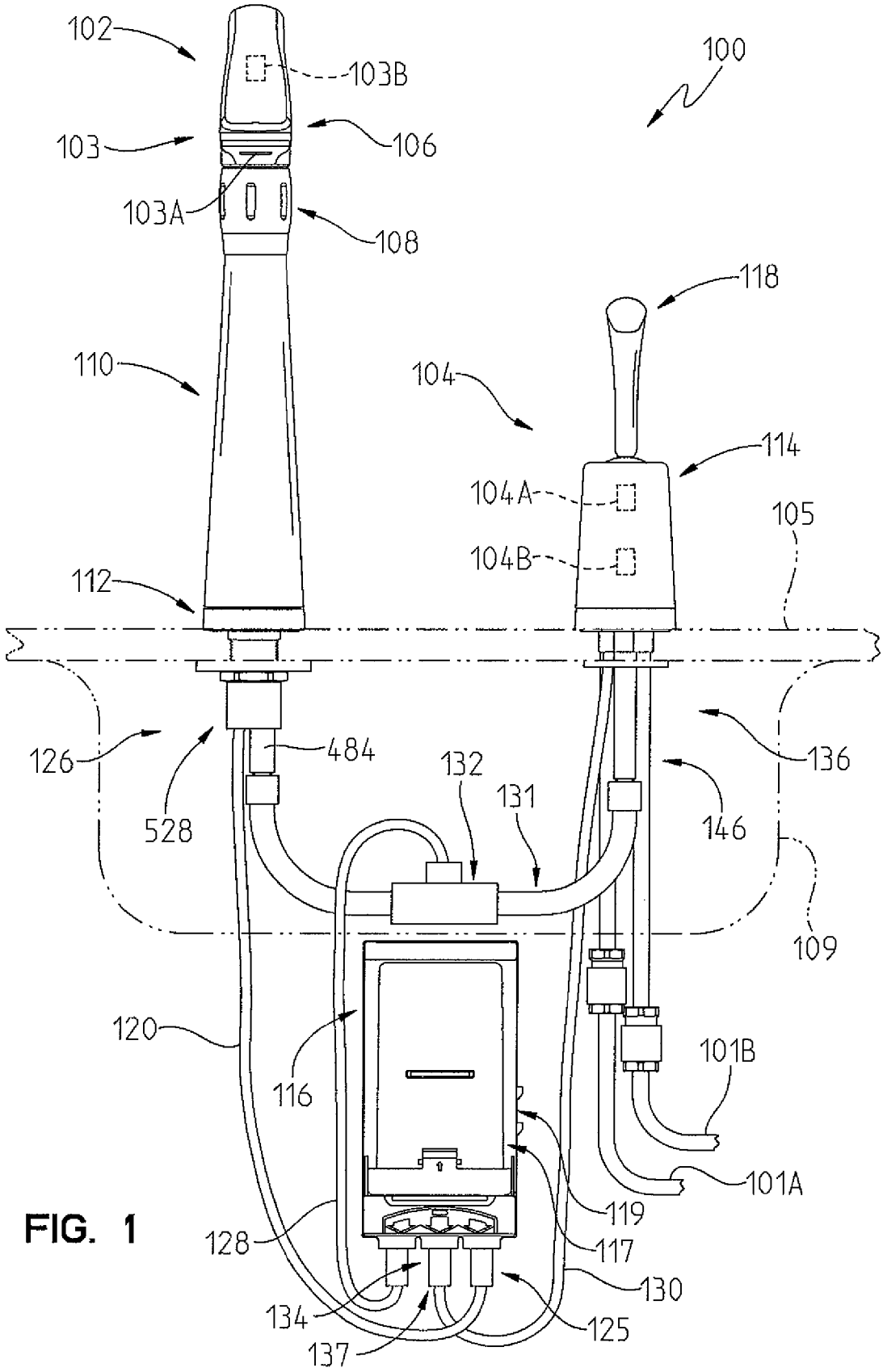
FIG. 1 is a front plan view of an illustrative embodiment electronic faucet system including a valve body assembly having an electrical cable extending therefrom to a controller assembly, and a spout assembly having an electrical cable extending therefrom to the controller assembly.

FIG. 1 is a perspective view of an illustrative embodiment kitchen-type faucet according to the present invention, indicated generally at 100. It will be appreciated that kitchen-type faucets and lavatory-type faucets are distinguished by a variety of features, such as the size of their spouts, the ability of the spout to swivel, and, often, the manual control. These features are related to the different applications for which they are used. Kitchen-type faucets are generally used for longer periods, and for washing and filling a variety of objects, while lavatory-type faucets are used mostly to wash the user's hands and face. Kitchen-type faucets typically have longer and higher spouts, in order to facilitate placing objects, such as dishes, pots, buckets, etc., under them. Kitchen-type faucets typically rise at least 6 inches above the deck of the sink, and may rise more than a foot. In addition, kitchen-type faucets typically swivel in the horizontal plane, so that they can be directed into either of the pair of basins in a typical kitchen sink. Lavatory-type faucets, on the other hand, are usually fixed, since even bathrooms with more than one sink basin are typically fitted with a separate faucet for each. In addition, kitchen-type faucets are generally controlled by a single manual handle that controls both the hot and cold water supplies, because it makes it easier to operate while one hand is holding something. Lavatory-type faucets more often have separate hot and cold water handles, in part for aesthetic reasons. Although there are exceptions to each of these general rules, in practice kitchen-type faucets and lavatory-type faucets are easily distinguished by users.

While the present invention's multi-mode operation is especially useful for kitchen sinks, the present invention may also be used with a lavatory-type faucet.

An illustrative embodiment faucet according to the present invention comprises a manually controlled valve in series with an actuator driven valve, illustratively a magnetically latching pilot-controlled solenoid valve. Thus, when the solenoid valve is open the faucet can be operated in a conventional manner, in a manual control mode. Conversely, when the manually controlled valve is set to select a water temperature and flow rate the solenoid valve can be touch controlled, or activated by proximity sensors when an object (such as a user's hands) is within a detection zone to toggle water flow on and off. An advantageous configuration for a proximity detector and logical control for the faucet in response to the proximity detector is described in greater detail in U.S. patent application Ser. No. 10/755,582, filed Jan. 12, 2004, entitled "Control Arrangement for an Automatic Residential Faucet," which is hereby incorporated in its entirety.

It will be appreciated that a proximity sensor is any type of device that senses proximity of objects, including, for example, typical infrared or ultrasound sensors known in the art. Touch or contact sensors, in contrast, sense contact of objects.

Magnetically latching solenoids comprise at least one permanent magnet. When the armature is unseated, it is sufficiently distant from the at least one permanent magnet that it applies little force to the armature. However, when a pulse of power is applied to the solenoid coil the armature is moved to the latched position, sufficiently close to the at least one permanent magnet that the armature is held in place. The armature remains seated in the latched position until a pulse of power is applied to the solenoid coil that generates a relatively strong opposing magnetic field, which neutralizes the latching magnetic field and allows a spring to drive the armature back to the unlatched position. Thus, a magnetically latching solenoid, unlike typical solenoids, does not require power to hold the armature in either position, but does require power to actuate the armature in both directions. While the preferred embodiment employs a magnetically latching solenoid valve, it will be appreciated that any suitable electrically operable valve can be used in series with the manual valve. For example, any type of solenoid valve can be used.

Illustratively, the electrically operable valve is relatively slow-opening and -closing, in order to reduce pressure spikes, known as "water hammer," and undesirable splashing. On the other hand, the valve should not open or close so slowly as to be irritating to the user. It has been determined that a valve opening or closing period of at least 0.5 seconds sufficiently suppresses water hammer and splashing.

Figure 2:
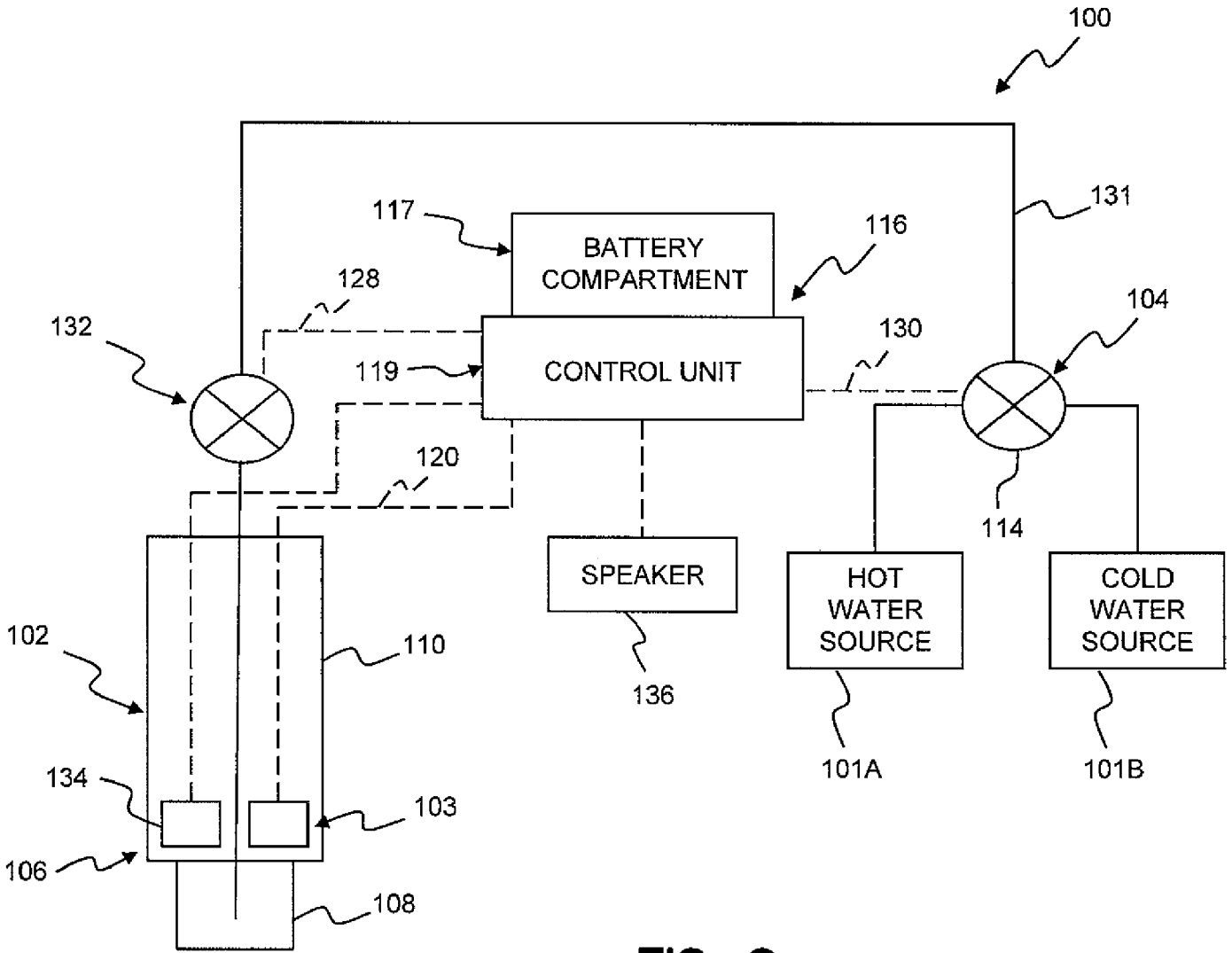
FIG. 2 is a block diagram illustrating the electronic faucet system of FIG. 1.
Figure 3:
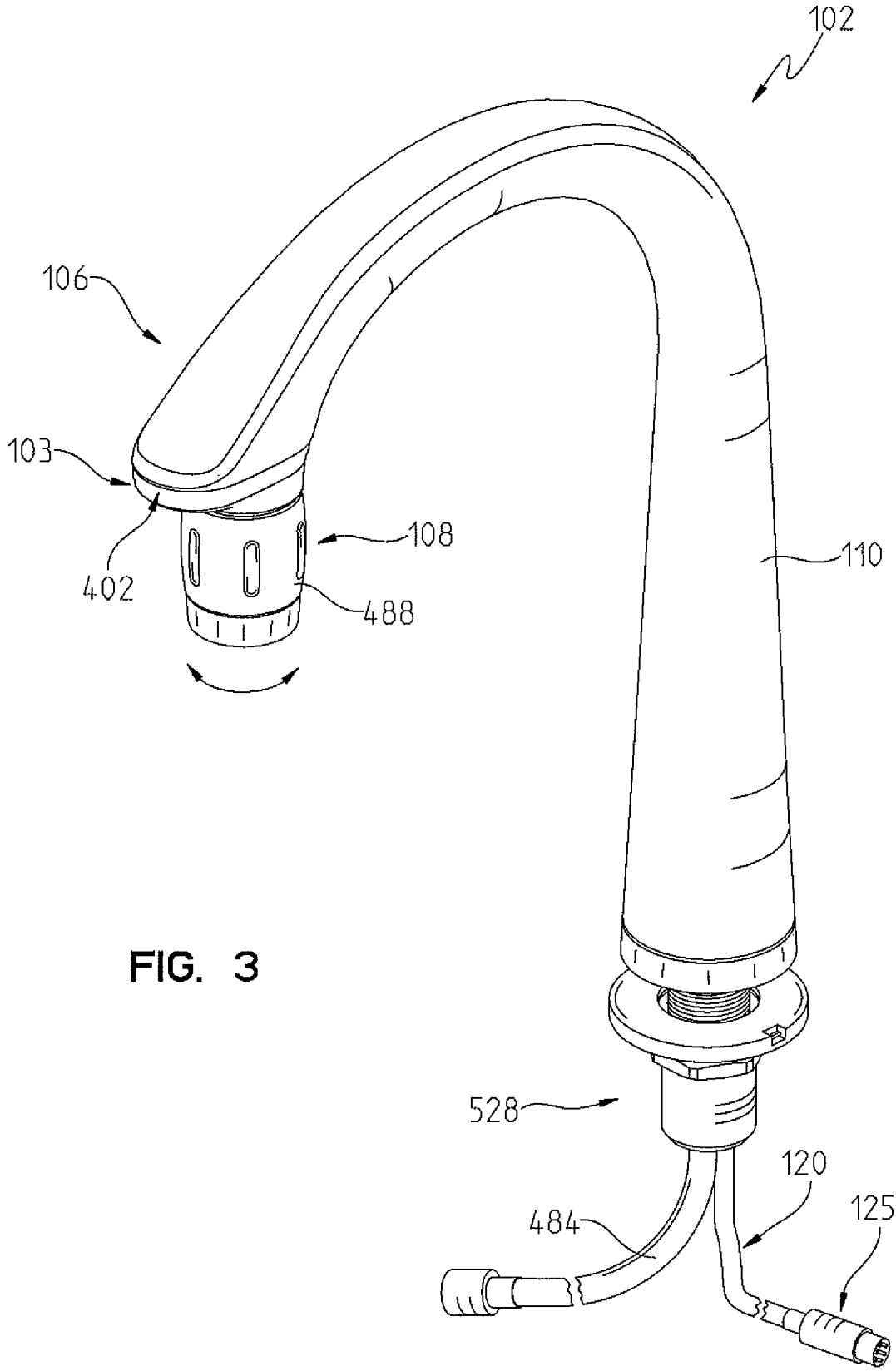
FIG. 3 is a top, front side perspective view of the spout assembly of FIG. 1.

Referring initially to FIGS. 1 and 2, an illustrative electronic faucet system 100 is shown fluidly coupled to a hot water source 101A and a cold water source 101B. Faucet system 100 includes a spout assembly 102 and a valve body assembly 104 mounted to a sink deck 105. As explained in more detail herein and in U.S. patent application Ser. No. 11/326,989, filed Jan. 5, 2006, entitled "Position-Sensing Detector Arrangement For Controlling A Faucet," the disclosure of which is expressly incorporated by reference herein, spout assembly 102 illustratively includes several electronic sensors. More particularly, spout assembly 102 illustratively includes a sensor assembly 103 having an infrared sensor 103A generally in an upper portion 106 of spout assembly 102 to detect the presence of an object, such as a user's hands. Sensor assembly 103 further illustratively includes a Hall effect sensor positioned in upper portion 106 to detect when a pull-out or pull-down spray head 108 is spaced apart from upper portion 106, for example when a user is directing water flow to desired objects within a sink basin 109. Sensor assembly 103 additionally illustratively includes a touch control, such as a capacitance touch sensor 103B wherein fluid flow from spout assembly 102 may be activated by the user touching spout assembly 102. Additional sensors or electronic devices may be positioned within or attached to spout assembly 102.

Due to the presence of electronics (such as the described sensors) generally within upper portion 106, a spout control electrical cable 120 is contained within a delivery spout 110 of spout assembly 102 and provides electrical communication between sensor assembly 103 and a controller 116. Illustratively, controller 116 includes a battery compartment 117 operably coupled to a logical control unit 119. Additional details of the controller 116 are provided in one or more of the Related Applications, including U.S. patent application Ser. No. 11/324,901, filed Jan. 4, 2006, entitled "Battery Box Assembly," the disclosure of which is expressly incorporated by reference herein.

Valve body assembly 104 also illustratively includes several sensors as explained in more detail in one or more of the Related Applications including U.S. patent application Ser. No. 11/326,986, filed Jan. 5, 2006, entitled "Valve Body Assembly With Electronic Switching," the disclosure of which is expressly incorporated by reference herein. Valve body assembly 104 illustratively includes a conventional manual valve member (such as a mixing ball or disc) to provide for the manual control of the flow and temperature of water in response to manual manipulation of a handle 118 supported for movement relative to a holder 114. A Hall effect sensor 104A is illustratively positioned in holder 114 to detect a position of the manual valve member, and hence, the handle 118. Valve body assembly 104 further illustratively includes a capacitance touch sensor 104B wherein fluid flow from spout assembly 102 may be activated by the user touching valve body assembly 104. Additional sensors or electronic devices may be positioned within or attached to valve body assembly 104. Due to the presence of electronics (such as the described sensors) generally within holder 114, a valve control electrical cable 130 is contained within holder 114 and provides electrical communication with controller 116.

With further reference to FIG. 2, the faucet system 100 is in fluid communication with hot water source 101A and cold water source 101B. The valve body assembly 104 illustratively mixes hot water from the hot water source 101 and cold water from the cold water source 101 to supply a mixed water to an actuator driven valve 132 through a mixed water conduit 131. Illustratively, the actuator driven valve 132 comprises a conventional magnetically latching solenoid valve of the type available from R.P.E. of Italy. The actuator driven valve 132 is controlled by the controller 116 through an electrical cable 128 and, as such, controls the flow of mixed water supplied to the spout assembly 102. As shown in FIGS. 1 and 2, the valves 104 and 132 are arranged in series and are fluidly coupled by mixed water conduit 131. The spout assembly 102 is configured to dispense mixed water through spray head 108 and into conventional sink basin 109.

As shown in FIGS. 1 and 2, when the actuator driven valve 132 is open, the faucet system 100 may be operated in a conventional manner, i.e., in a manual control mode through operation of the handle 118 and the manual valve member of valve body assembly 104. Conversely, when the manually controlled valve body assembly 104 is set to select a water temperature and flow rate, the actuator driven valve 132 can be touch controlled, or activated by proximity sensors when an object (such as a user's hands) are within a detection zone to toggle water flow on and off.

In an illustrative embodiment, the actuator driven valve 132 is controlled by electronic circuitry within control unit 119 that implements logical control of the faucet assembly 100. This logical control includes at least two functional modes: a manual mode, wherein the actuator driven valve 132 remains open, and a hands-free mode, wherein the actuator driven valve 132 is toggled in response to signals from a proximity sensor. Thus, in the manual mode, the faucet assembly 100 is controlled by the position of the handle 118 in a manner similar to a conventional faucet, while in the hands-free mode, the flow is toggled on and off in response to the proximity sensor (while the flow temperature and rate are still controlled by the handle 118 position). The logical control may also include a further functional mode: a touch mode such that tapping of one of the handle 118 and the spout 110 toggles water flow on and off. As further detailed herein, tapping is illustratively defined as a touch by a user having a duration of less than approximately 350 milliseconds and greater than approximately 50 milliseconds. Grasping, in turn, is defined as a user touch having a duration of more than approximately 350 milliseconds. In one illustrative embodiment of the touch mode, tapping either the handle 118 and the spout 110 or a grasping of the handle 118 activates actuator driven valve 132, while grasping the spout 110 alone has no effect.

Illustratively, the faucet assembly 100 is set to operate in a hands-free mode by user interaction, for example by input from a push-button, by input from a strain gauge or a piezoelectric sensor incorporated into a portion of the faucet assembly 100, such as the spout assembly 102, or by input from a capacitive touch button or other capacitive touch detector. It will be appreciated that a touch control, whether implemented with a strain gauge or a capacitive touch-sensor can respond to contact between a user and the handle 118 that is insufficient to change a position of the handle 118.

The capacitive touch control 103B may be incorporated into the spout assembly 102 of the faucet assembly 100, as taught by U.S. Pat. No. 6,962,168, entitled "Capacitive Touch On/Off Control For An Automatic Residential Faucet," the disclosure of which is expressly incorporated by reference herein. In certain illustrative embodiments, the same mode-selector can be used to return the faucet assembly 100 from hands-free mode to manual mode. In certain of these illustrative embodiments, as detailed herein, a touch-sensor 104B is also incorporated into the handle 118. In such illustrative embodiments, the two touch controls can either operate independently (i.e. mode can be changed by touching either one of the touch controls), or together, so that the mode is changed only when both touch controls are simultaneously touched.

More particularly, in one illustrative embodiment, the mode of the logical control may be changed by simultaneously grasping the spout 110 and tapping the handle 118. In the illustrative embodiment, the mode is toggled from hands free on (i.e., proximity sensor active) to hands free off (i.e., proximity sensor inactive) by simultaneously grasping the spout 110 and tapping the handle 118 twice in order to reduce inadvertent mode changes. As detailed above, grasping is defined by a user contact lasting longer than approximately 350 milliseconds, while tapping is defined as user contact lasting less than approximately 350 milliseconds. As such, the threshold value of 350 milliseconds permits the logical control to distinguish between these two types of contact with a user. However, in other embodiments this value may be different, for example it may be equal to 250 milliseconds.

In certain alternative embodiments, once placed in hands-free mode the faucet assembly 100 can be returned to manual mode simply by returning the manual faucet control handle 118 to a closed position. In addition, in certain illustrative embodiments the faucet assembly 100 returns to manual mode after some period of time, such as 20 minutes, without user intervention. This time-out feature may be useful for applications in which power is supplied by batteries, because it preserves battery life. In one illustrative embodiment, once the hands-free mode is activated, the actuator driven valve 132 is closed, stopping the water flow. This state is the hands-free standby state, in which water flow will be activated by a proximity detector. The manual valve handle 118 preferably remains in the open position. In other words, the manual valve body assembly 104 remains open, so that flow is halted only by the actuator driven valve 132.

In the hands-free standby state, objects positioned within the sensor's trigger zone cause the faucet assembly 100 to enter the hands-free active state, wherein the actuator driven valve 132 is opened, thus permitting the water to flow. The faucet assembly 100 remains in hands-free active mode, and the actuator driven valve 132 remains open, as long as objects are detected within the sensor's trigger zone. When objects are no longer detected in the sensor's trigger zone, the faucet assembly 100 returns to hands-free standby mode, and the actuator driven valve 132 closes.

It will be appreciated that water flow is important while a user is attempting to adjust the flow rate or temperature. More particularly, the user observes these properties as they are adjusted, in effect completing a feedback loop. Thus, adjustment of the flow properties is another case in which water flow is preferably activated without requiring the user to place his or her hands or an object in the trigger zone. Therefore, in the illustrative embodiment, when the faucet assembly 100 is in standby hands-free mode, the faucet assembly 100 switches to active hands-free mode, and the actuator driven valve 132 is opened, whenever the manual control handle 118 is touched.

In certain alternative embodiments, when the handle 118 is touched while in hands-free mode, the faucet assembly 100 switches to manual mode, which will, of course, also result in activating the water flow (unless the handle is closed), as well as the deactivation of the proximity sensor. If the user wishes to then return to hands-free mode, he or she may reactivate it in the usual way, such as by a touch control.

In the illustrative embodiment, the faucet assembly 100 does not immediately enter the hands-free mode when the manual valve body assembly 104 is opened and released. Instead, the faucet assembly 100 enters a "quasi-hands-free" state, in which the faucet assembly 100 continues to be manually controlled, and the actuator driven valve 132 remains open. This quasi-hands-free state persists as long as the proximity sensor does not detect the presence of an object within the sensor's trigger zone. This allows the faucet assembly 100 to function as a normal manual valve when initially operated, but to switch modes to hands-free automatically when sensing the presence of an object within the trigger zone. The advantage of this quasi-hands-free mode is that the faucet assembly 100 can be operated as a conventional manual faucet without the necessity of manually selecting the manual mode. This is valuable, for example, in single-use activations such as getting a glass of water or when guests use the faucet assembly 100. In these embodiments, when the user initially opens the faucet assembly 100 and adjusts the water temperature or flow rate and then releases the handle 118, the water does not immediately shut off, thereby frustrating the user's attempt to operate the faucet assembly 100 as a manual faucet. After the user has adjusted the flow, and places an object within the faucet assembly's detection zone, the faucet assembly 100 will then enter hands-free mode.

Because the behavior of the faucet assembly 100 in response to its various input devices is a function of the mode it is presently in, illustratively, the faucet assembly 100 includes some type of low-power mode indicator 134 to identify it's current mode. Appropriate indicators include LEDs (light emitting diodes), LCDs (liquid crystal displays), or a magnetically latching mechanical indicator. In certain embodiments, the mode indicator 134 may simply be a single bit indicator (such as a single LED) that is activated when the faucet assembly 100 is in hands-free mode. Alternatively, the mode indicator 134 may include a separate bit display for each possible mode. In still other embodiments, the mode indicator 134 may indicate mode in some other way, such as a multi-color LED, in which one color indicates hands-free mode, and one or more other colors indicate other modes. Further, and as detailed herein, transition between modes may illustratively be indicated by an audio output.

Illustratively, the mode indicator 134 comprises a reflector cooperating with a light pipe (not shown) which is configured to assist in directing light from an LED to a forward projecting lens in the manner detailed U.S. patent application Ser. No. 11/325,128, filed Jan. 4, 2006, entitled "Spout Assembly For An Electronic Faucet," which has been incorporated by reference herein. The mode indicator 134 is operably coupled to the logical control 119. The logical control 119 provides several different operational states for the mode indicator 134. In a first operational state, which is illustratively the default state, the mode indicator 134 provides a blue light to indicate that the proximity sensor is active thereby providing hands free operation, and provides a red light to indicate a low battery condition. In a second operational state, which is a hands-free flash state, the mode indicator 134 provides a flashing blue light when the proximity sensor is active, provides a solid blue light when water is running due to hands free activation, and provides a magenta color when water is flowing due to touch activation. In a third operational state, all mode indicator functions are disabled, with the exception of a red light to indicate low battery. In a fourth operational state, which is a debug state, the mode indicator 134 provides a solid blue light when the proximity sensor is active, provides a flashing magenta color when a spout touch is sensed, provides a solid magenta color when a valve touch is sensed, provides a solid red color when the actuator driven valve 132 is activated, and provides a flashing red light when the pull down sensor, as described herein, is activated. In a fifth operational state, which is a show room state, the mode indicator 134 provides a solid blue light whenever water should be flowing.

As noted above, an audio output may be provided to indicate transition between modes. More particularly, an audio device, illustratively a speaker 136, is operably coupled to the logical control 119 and is configured to provide an audible indication of transition between modes. In one illustrative embodiment, the speaker 136 provides an ascending tone when the logical control 119 transitions from a hands free off mode (i.e., proximity sensor is inactive) to a hands free on mode (i.e., proximity sensor is active). Similarly, the audio speaker 136 provides a descending tone when the logical control 119 transitions from the hands free on mode to the hands free off mode.

The speaker 136 may also provide audible indications for other system conditions. For example, the speaker 136 may provide an audible tone for a low battery condition. The speaker 136 may also provide a distinct tone upon initial start up of the system.

When a user is finished using the faucet assembly 100, the faucet assembly 100 is illustratively powered down and returned to a baseline state. Powering down provides power savings, which makes it more feasible to operate the faucet assembly 100 from battery power. Returning the faucet assembly 100 to a baseline state is helpful because it gives predictable behavior when the user first begins using the faucet assembly 100 in a particular period of operation. Preferably, the baseline state is the manual mode, since the next user of the faucet assembly 100 might not be familiar with the hands-free operation. Illustratively, a user is able to power down the faucet assembly 100 and return it to the manual, baseline mode simply by returning the manual handle 118 to the closed position, because this is a reflexive and intuitive action for users.

As a consequence, the illustrative embodiment faucet assembly 100 is configured to sense whether the handle 118 is in the closed position. It will be appreciated that this can be accomplished directly, via a sensor in the valve body assembly 104 that detects when the manual valve member is closed, such as by including a small magnet in the handle 118, and an appropriately positioned Hall effect sensor. Alternatively, the handle position can be observed indirectly, for example by measuring water pressure above and below the manual valve, or with a commercial flow sensor. However, it will be appreciated that this inference (that the handle 118 is in a closed position) is only valid if the electrically operable valve is open. It will be appreciated that, because the actuator driven valve 132 is controlled electronically, this is easily tracked by the controller 116. Thus, in the illustrative embodiment, the faucet assembly 100 is returned to manual mode when both the actuator driven valve 132 is open and water is not flowing through the faucet assembly 100.

Illustratively, the faucet assembly 100 also includes a "watchdog" timer, which automatically closes the actuator driven valve 132 after a certain period of time, in order to prevent overflowing or flooding. In certain of these illustrative embodiments, normal operation is resumed once an object is no longer detected in the sensor's trigger zone. In certain other illustrative embodiments, normal operation is resumed once the manual valve body assembly 104 is closed. In still other illustrative embodiments, normal operation is resumed in either event. In those illustrative embodiments including a hands-free mode indicator 134, the indicator is flashed, or otherwise controlled to indicate the time-out condition.

In addition to the various power-saving measures described above, the illustrative embodiment also includes an output mechanism that alerts users when batter power is low. It will be appreciated that any suitable output mechanism may be used, but illustratively mode indicator 134 and audio speaker 136 are used.

Figure 4A:
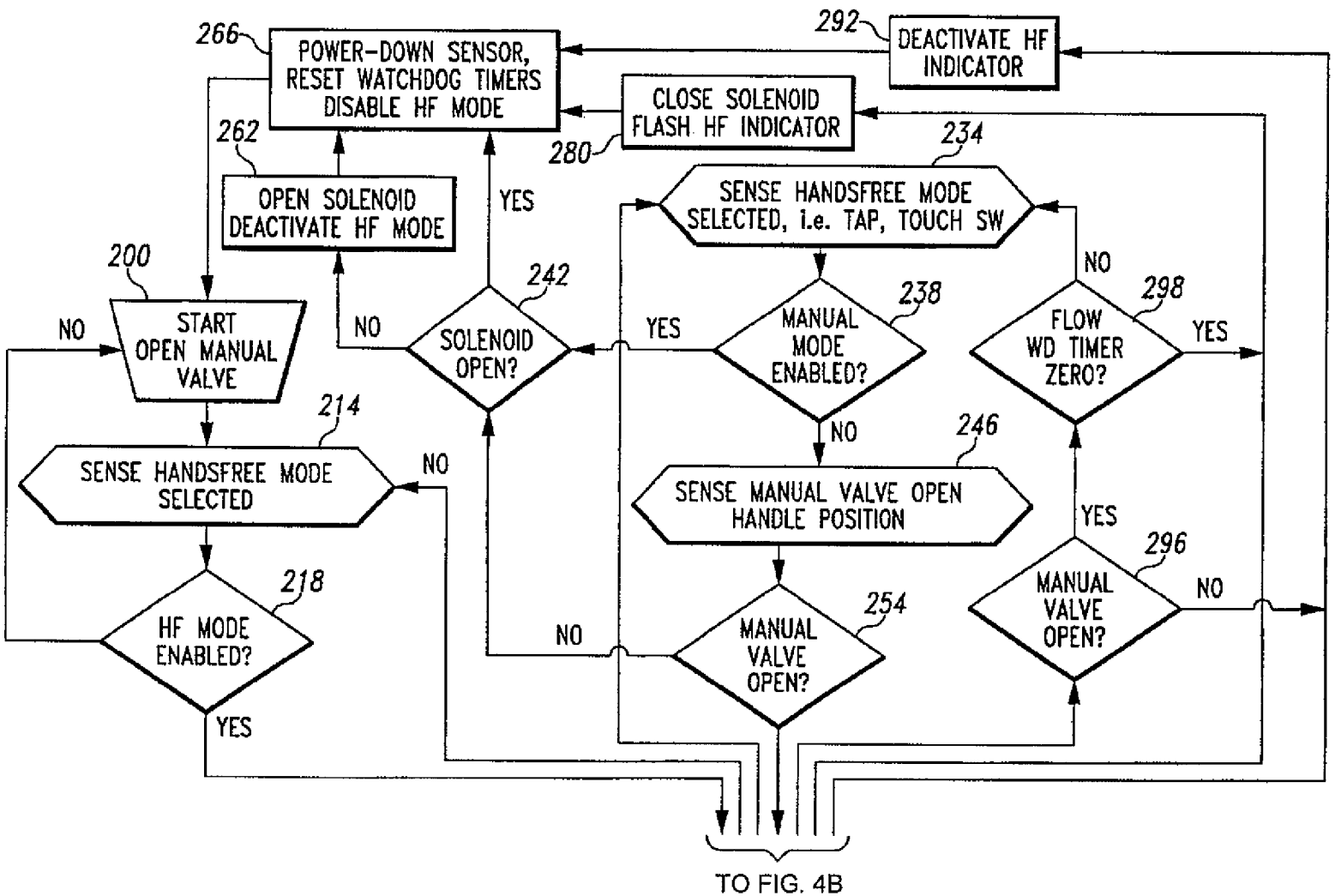
FIGS. 4A and 4B are diagrams of a logical control for an illustrative embodiment faucet according to the present invention.
Figure 4B:
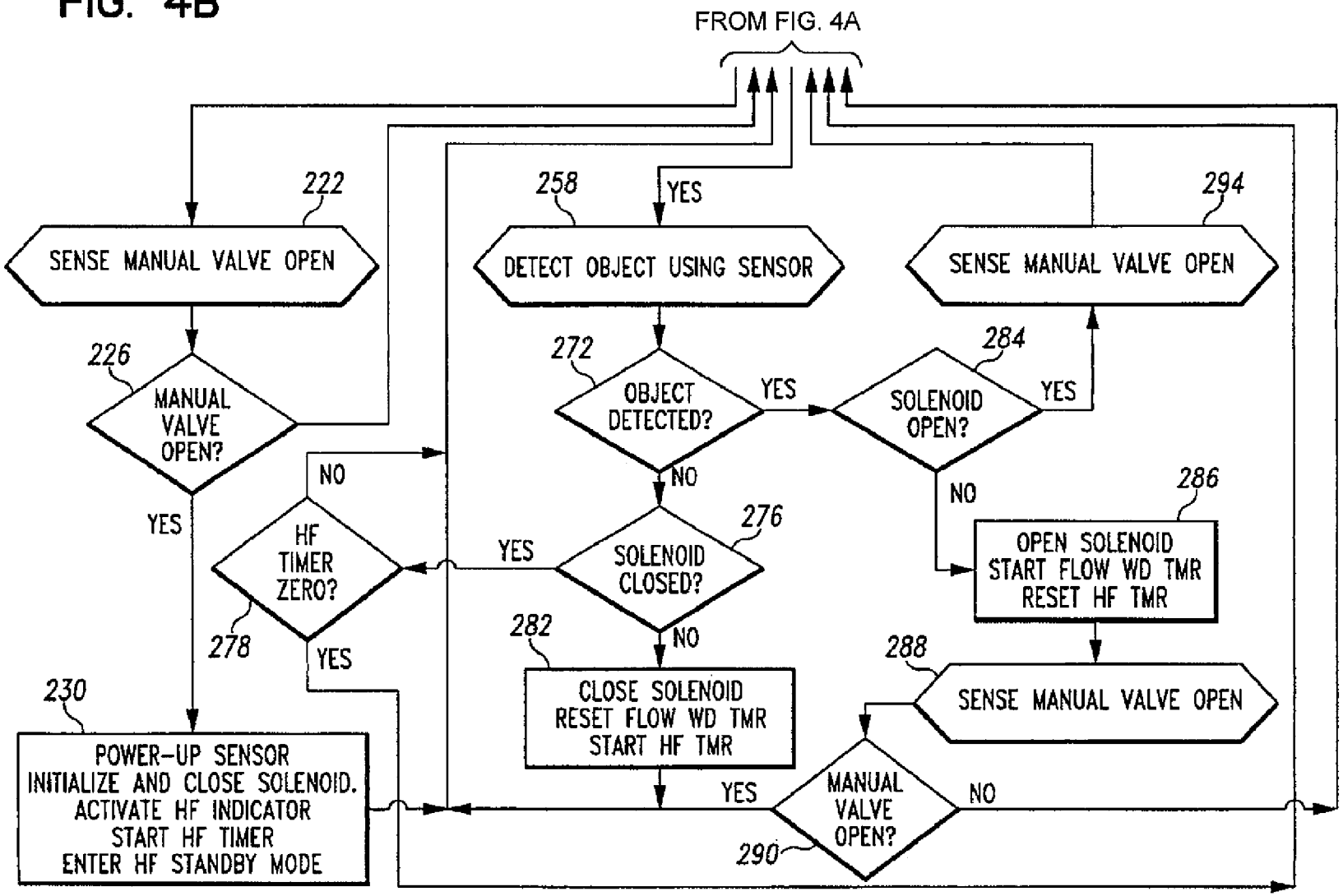

FIGS. 4A and 4B are a flowchart illustrating the logical control 119 for a preferred embodiment faucet according to the present invention. The logical control 119 begins each use session at 200, when the manual handle 118 is used to open the manual valve 104. At this time, the faucet is in the manual mode (which fact will be displayed by the mode indicator 134, in those embodiments wherein the mode sensor does not simply activate to indicate hands-free mode). At 214 the mode selectors, including the touch sensor in the spout and the touch-button, are monitored for instructions from the user to enter hands-free mode. At 218 it is determined whether the hands-free mode has been enabled. If not, the logical control 119 returns to 200. If at 218 it is determined that the hands-free mode has been enabled, at 222 the flow sensor is monitored to determine whether the manual valve is open. At 226 it is determined whether the manual valve 104 is open. If not, the logical control 119 returns to 214. If at 226 it is determined that the manual valve 104 is open, hands-free mode is activated at 230.

At 230, hands-free mode is activated by powering up the proximity sensor, initializing and closing the electrically operable valve 132 (thereby shutting off water flow), activating the mode indicator 134 to display hands-free mode, and initializing the hands-free timer. At this time, the faucet is in hands-free standby mode.

At 234 the mode selectors are monitored for instructions to return to manual mode. At 238, it is determined whether manual mode has been enabled. If so, at 242 it is determined whether the electrically operable valve 132 is open. If at 238 it is determined that manual mode has not been enabled, at 246 the manual handle position is sensed, and at 254 it is determined whether the manual valve 104 is open. If not, at 242 it is determined whether the electrically operable valve 132 is open.

If at 242 it is determined that the electrically operable valve 132 is closed (a "No" result), at 262 the solenoid is opened, and the mode indicator 134 is set to no longer display hands-free mode. If at 242 it is determined that the electrically operable valve 132 is open, or after it is opened at 262, then at 266 the proximity sensor is powered down and the hands-free and watchdog timers are reset. At this time the faucet is in manual mode, and the logical control 119 returns to 200.

If at 254 it is determined that the manual valve 104 is open, then at 258 the proximity sensor is monitored. At 272 it is determined whether the proximity detector has detected an object that should activate water flow. If not, at 276 it is determined whether the solenoid is closed. If at 276 it is determined that the solenoid is closed, at 278 it is determined whether the hands-free timer has expired. If at 278 the hands-free timer has not expired, the logical control 119 returns to 234; otherwise it proceeds to 280, where the solenoid is closed, and the mode indicator 134 is activated to indicate the timeout condition, after which the logical control 119 passes to 266. If at 276 it is determined that the solenoid is not closed, then at 282 the solenoid is closed, the watchdog timer is reset, and the hands-free timer is started, and the logical control 119 then returns to 234.

If at 272 it is determined that an object has been detected which requires that water flow be started, then at 284 it is determined whether the electrically operable valve 132 is open. If not, at 286 the solenoid is opened, the watchdog timer is started, and the hands-free timer is restarted. Then, at 288 the manual valve status is sensed. At 290 it is determined whether the manual valve 104 is open. If so, the logical control returns to 234. Otherwise, at 292 the mode indicator is activated to indicate that the faucet is no longer in hands-free mode, and the logical control 119 then passes to 266.

If at 284 it is determined that the electrically operable valve 132 is open, then at 294 the manual valve status is sensed. At 296 it is determined whether the manual valve 104 is open. If not, the logical control 119 proceeds to 292. If at 296 it is determined that the manual valve 104 is open, then at 298 it is determined whether the watchdog timer has expired. If not, the logical control 119 returns to 234, but if so, the logical control proceeds to 280.

In the illustrative embodiment the spout of the faucet is a "pull-down" spout. Those skilled in the art will appreciate that a pull-down spout is a spout that includes an extendible hose that connects it to the valve assembly, thereby permitting the spout to be pulled out from its rest position, where it can be used similarly to a garden hose, to direct water as the user wishes. In the preferred embodiment, when the pull-down spout is extended the faucet the electrically operable valve is automatically opened, so that water flow is controlled by the manual handle. In certain embodiments, this is effected by returning the faucet to manual mode. In certain other embodiments, though, when the spout is retracted the faucet resumes hands-free operation (assuming it was in hands-free mode when the spout was extended). Thus, in these embodiments, when the spout is extended the faucet effectively enters another mode. Note that this mode need not be distinguished from the hands-free mode by the mode indicator, though, since its presence will be obvious and intuitively understood because of the extended spout. Preferably, the electrically operable valve can be toggled by the tap control during this extended-spout mode.

In the illustrative embodiment, the automatic faucet detects that the pull-down spout has been pulled down using Hall-Effect sensors. However, it will be appreciated that any suitable means of detecting that the pull-down spout has been extended may be used.

Figure 5:
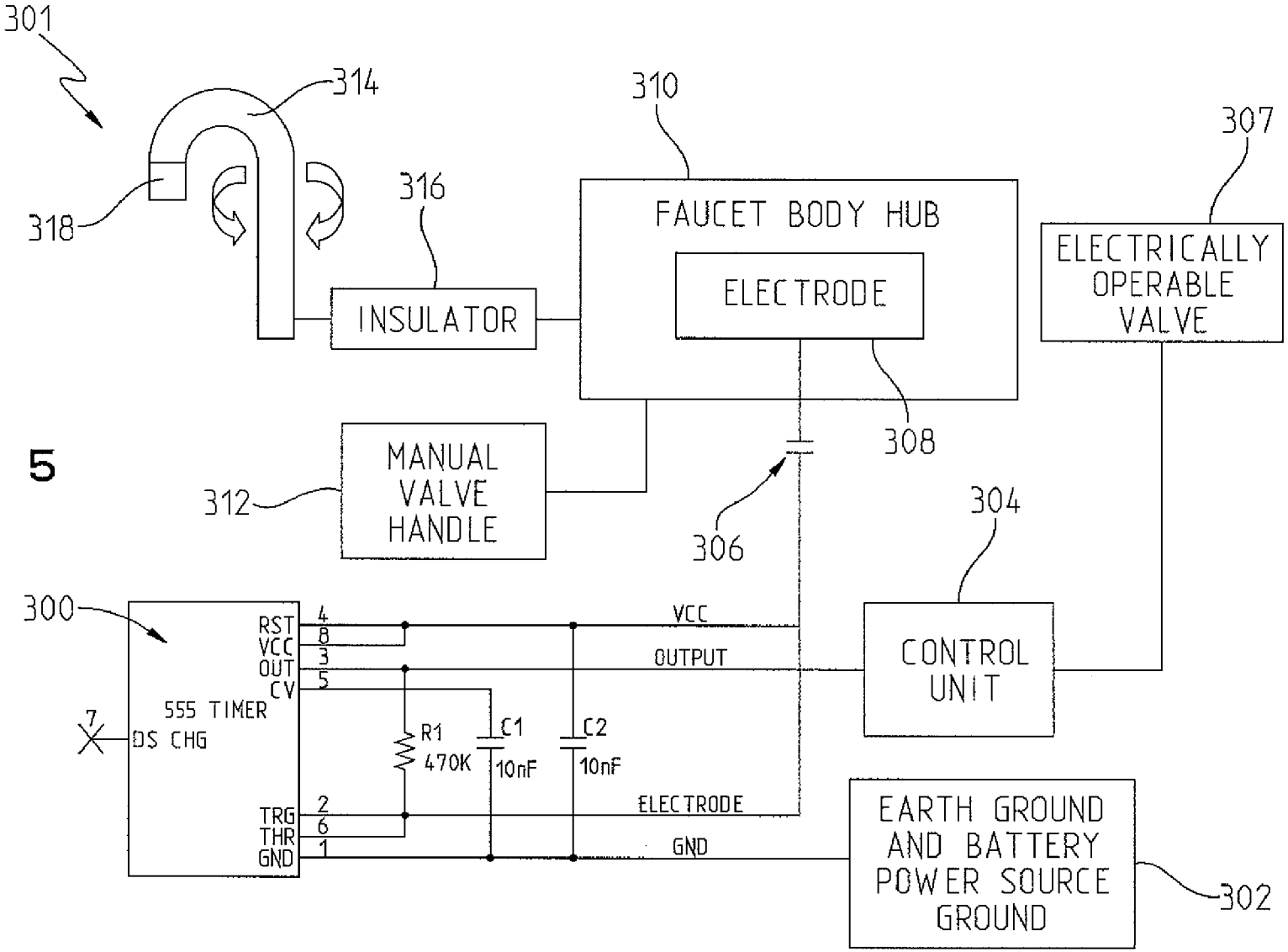
FIG. 5 is a block diagram with schematic portions illustrating another embodiment of the present invention which provides a capacitive sensor for use with a single hole mount faucet.
Figure 6:
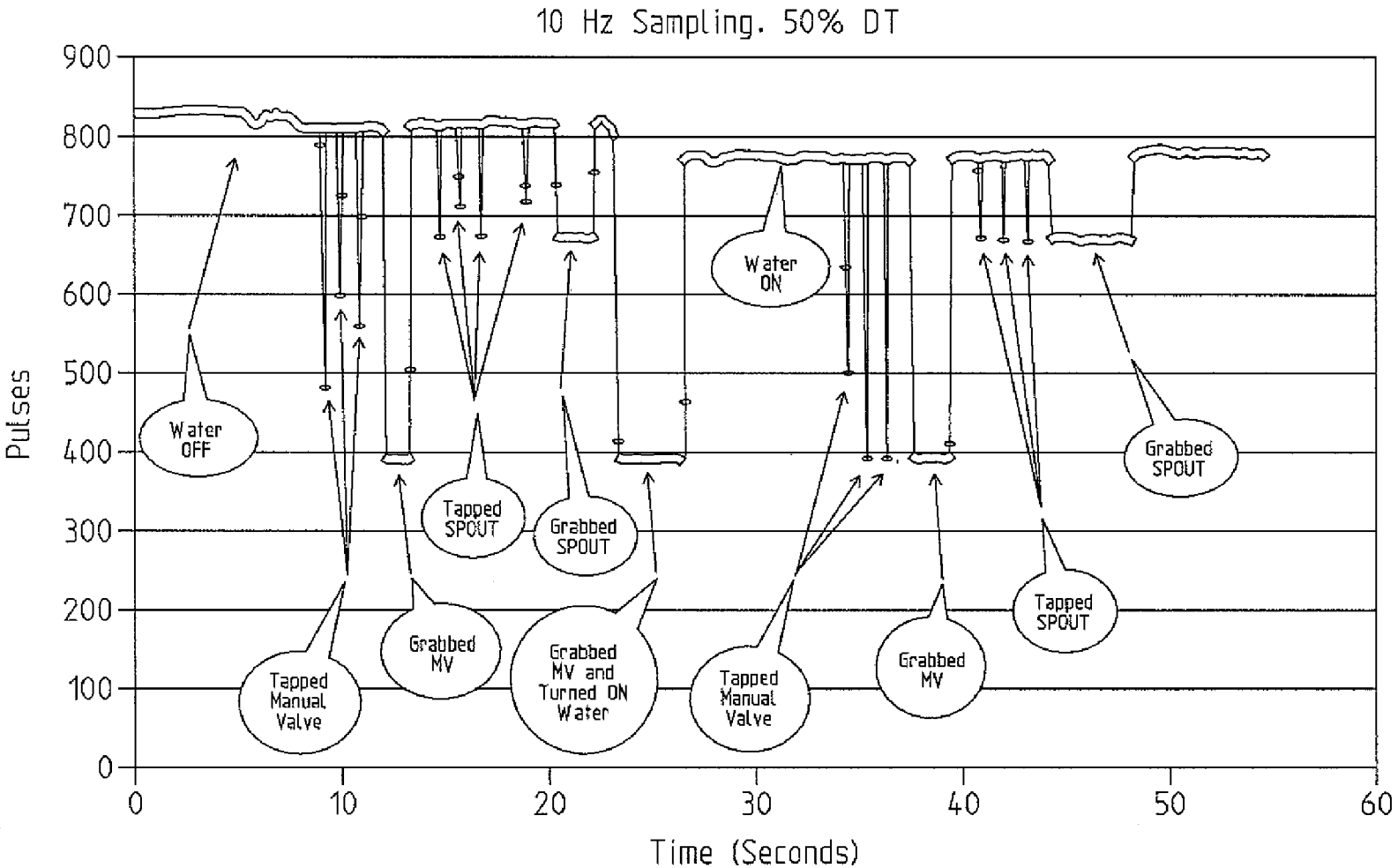
FIG. 6 is an illustrative output from the capacitive sensor of the embodiment of FIG. 5.

Another embodiment of the present invention is illustrated in FIGS. 5 and 6. In this embodiment, a sensor, illustratively a capacitive sensor, is provided for use with a single hole mount faucet 301. While a capacitive sensor is shown in this embodiment for use in connection with a capacitive coupling, a resistance sensor may also be used in connection with a resistive coupling, as further detailed below. In the illustrated embodiment of FIG. 5, a oscillator integrated circuit such as, for example, a 555 timer 300 is used as the capacitive sensor. Timer 300 may be a IMC 7555 CBAZ chip. It is understood that other types of capacitive sensors may also be used in accordance with the present invention. Pins of the timer 300 are shown in FIG. 5.

In the illustrated embodiment, pin 1 of timer 300 is coupled to earth ground and to a battery power source ground as illustrated at block 302. An output of timer 300 is coupled to a controller 304 which is similar to controller 116 discussed above. Pin 2 of timer 300 is coupled through a 1 nF capacitor 306 to an electrode 308. Electrode 308 is coupled to the faucet body hub 310. It should be appreciated that the faucet body hub 310 itself may comprise the electrode 308. As further detailed below, faucet body hub 310 is also electrically coupled to a manual valve handle 312, for example by metal-to-metal contact between the handle 312 and the hub 310. Manual valve handle 312 is movably coupled to the faucet body hub 310 in a conventional manner to control water flow. Since the manual valve handle 312 and the faucet body hub 310 are electrically connected, the electrode 308 may also be coupled to the manual valve handle 312, if desired. Again, electrode 308 may comprise the manual valve handle 312 itself.

As further detailed below, spout 314 is capacitively coupled to faucet body hub 310 by an insulator 316. In one embodiment, such as for a kitchen faucet, the spout 314 is rotatable relative to the faucet body hub 310. In other embodiments, the spout 314 may be fixed relative to the faucet body hub 310. Spout 314 may include a pull-out or pull-down spray head 318 which is electrically isolated from the spout 314.

The faucet body hub 310 provides sufficient capacitance to earth ground for the timer 300 to oscillate. As further discussed herein, the manual valve handle 312 is electrically connected to the faucet body hub 310. The spout 314 is capacitively coupled to the body hub 310 by insulator 316 to provide approximately a 100 pF capacitance. When the manual valve handle 312 is touched by a user's hand, the capacitance to earth ground is directly coupled. The capacitive sensor 300 therefore detects a larger capacitance difference when the handle 312 is touched by a user compared to when the spout 314 is touched. This results in a significant frequency shift when the manual valve handle 312 is touched by a user's hand. However, when the same user touches the spout 314, the frequency shift is substantially lower. For example, the frequency shift may be over 50% lower. By measuring the frequency shift compared to a baseline frequency, the controller 304 can detect where the faucet 301 is touched and how long the faucet 301 is touched to enable the controller to make water activation decisions as discussed herein.

FIG. 6 illustrates an output signal from pin 3 of timer 300 which is supplied to controller 304. The controller 304 can determine whether the manual valve handle 312 is tapped (short duration, lower frequency) or grabbed (long duration, lower frequency) and whether the spout 314 is tapped (short duration, higher frequency) or grabbed (long duration, higher frequency). The controller 304 may use this information to control operation of the faucet 301, and more particularly of the electrically operable valve 307, in different modes. The embodiment of FIGS. 5 and 6 may also be used with a proximity sensor (not shown), if desired, for a hands free mode.

Figure 7:
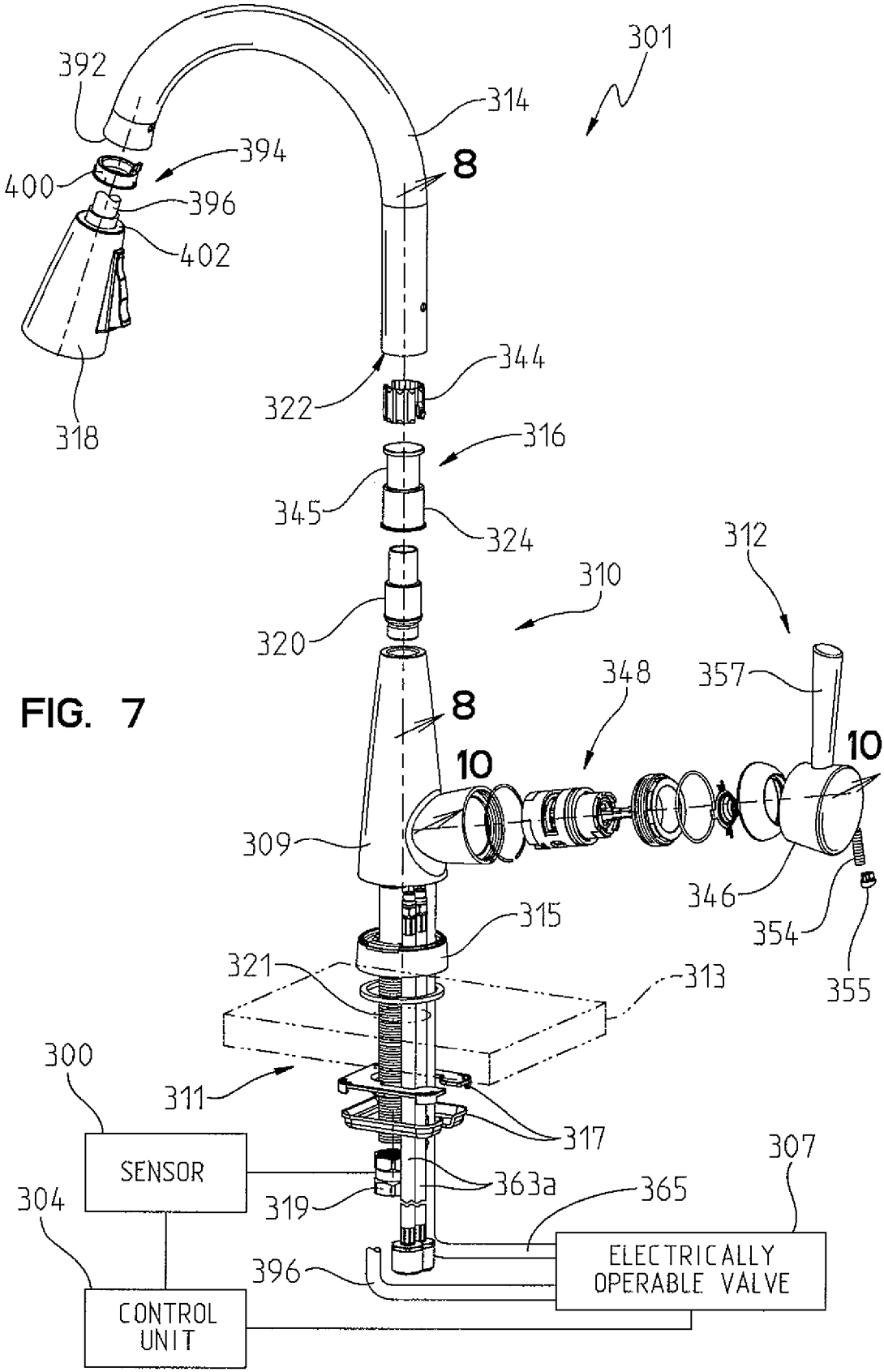
FIG. 7 is an exploded perspective view of an illustrative embodiment single hole mount faucet.

FIG. 7 shows illustrative single hole mount faucet 301 including faucet body hub 310 having a base 309 formed of an electrically conductive material, illustratively brass or zinc with a chrome plated finish. The hub 310 also includes an upwardly extending inner hub or member 320 formed of an electrically conductive material, illustratively brass. Inner member 320 is illustratively threadably coupled to base 309. Base 309 is coupled to a sink deck 313 through a mounting assembly 311. The mounting assembly 311 includes upper and lower members 315 and 317 which clamp faucet 301 to the sink deck 313. Upper and lower members 315 and 317 illustratively electrically isolate faucet 301 from sink deck 313 by the use of electrically isolating materials, such as thermoplastics.

A nut 319 threadably engages a shank 321 coupled to base 309 to move lower member 317 toward sink deck 313. Sensor 300 is illustratively electrically coupled to nut 319 which, in turn, is electrically coupled to base 309 through shank 321. Inner member 320 is illustratively concentrically received within a lower end 322 of spout 314. Spout 314 is also formed of an electrically conductive material, and is illustratively either a mechanically formed or hydroformed brass tube with a chrome plated or PVD finished outer surface.

Figure 8:
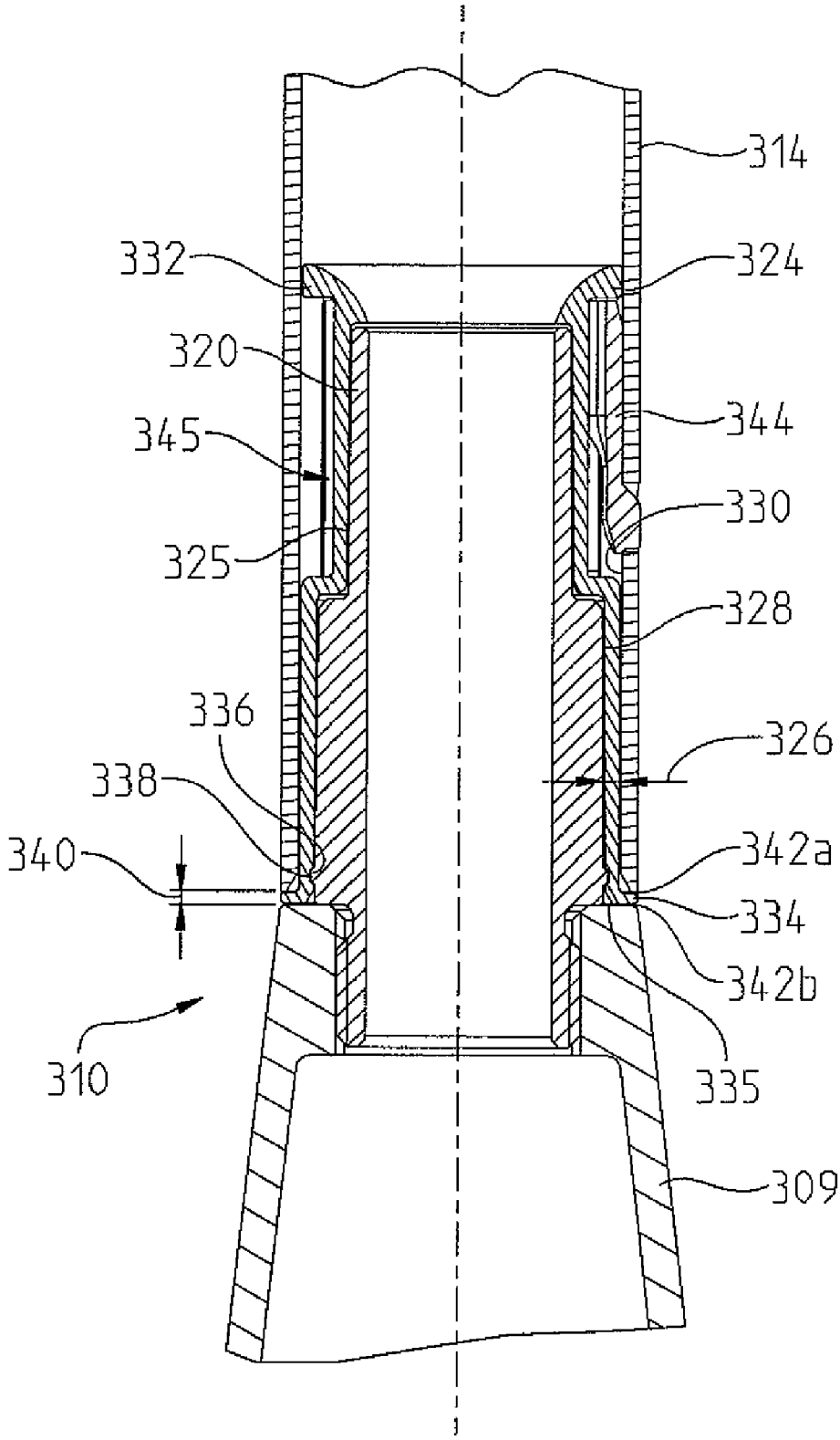
FIG. 8 is a partial cross-sectional view of the faucet of FIG. 7 taken along line 8-8.

With further reference to FIGS. 7 and 8, insulator 316 illustratively comprises a substantially cylindrical sleeve 324 having a side wall 325 which defines an annular space or gap 326 between an outer surface 328 of inner member 320 of hub 310 and an inner surface 330 of spout 314. Upper end of sleeve 324 includes a locating ring 332, and lower end of sleeve 324 includes an insulating flange 334. Sleeve 324 is formed of an electrically insulating material, illustratively having a permittivity or dielectric constant of between about 3.5 to 4.0 when it defines a gap 326 of about 0.05 inches, to define the desired capacitance value as further detailed below. In one illustrative embodiment, sleeve 324 is formed of a thermoplastic, and more particularly from a polybutylene terephthalate (PBT), such as Celenex PBT 2002. Side wall 325 of sleeve 324 prevents the spout 314 from coming into electrical contact with the inner member 320 of hub 310, while flange 334 prevents spout 314 from coming into electrical contact with the upper end 335 of base 309 of hub 310.

Side wall 325 of sleeve 324 includes an undercut or annular groove 336 which receives an annular protuberance or ridge 338 formed on outer surface of inner member 320. In one illustrative embodiment, ridge 338 snaps into groove 336 to couple inner member 320 to sleeve 324 and prevent vertical disassembly thereof.

Flange 334 of sleeve 324 provides a spacing or gap 340, illustratively about 0.035 inches to reduce the effect of water droplets bridging upper end of base 309 and lower end of spout 314. Upper spacing 342*a* between flange 334 and spout 314, and lower spacing 342*b* between flange 334 and base 309 creates a capillary action that dissipates water droplets.

A friction spacer 344 is positioned intermediate insulator sleeve 324 and spout 314 to prevent undesired movement or "wobbling" therebetween. Friction spacer 344 is received within an annular recess 345 of sleeve 324 and is illustratively formed of an electrically non-conductive material, such as molded thermoplastic. In one embodiment, spacer 344 is formed of Celenex PBT 2002.

As detailed above, spout 314 is capacitively coupled to faucet hub 310 for the purpose of touch differentiation. Spacing between spout 314 and hub 310 creates a capacitive coupling therebetween. This capacitive coupling allows for differentiation between contact with spout 314 and contact with hub 310.

Figure 9:
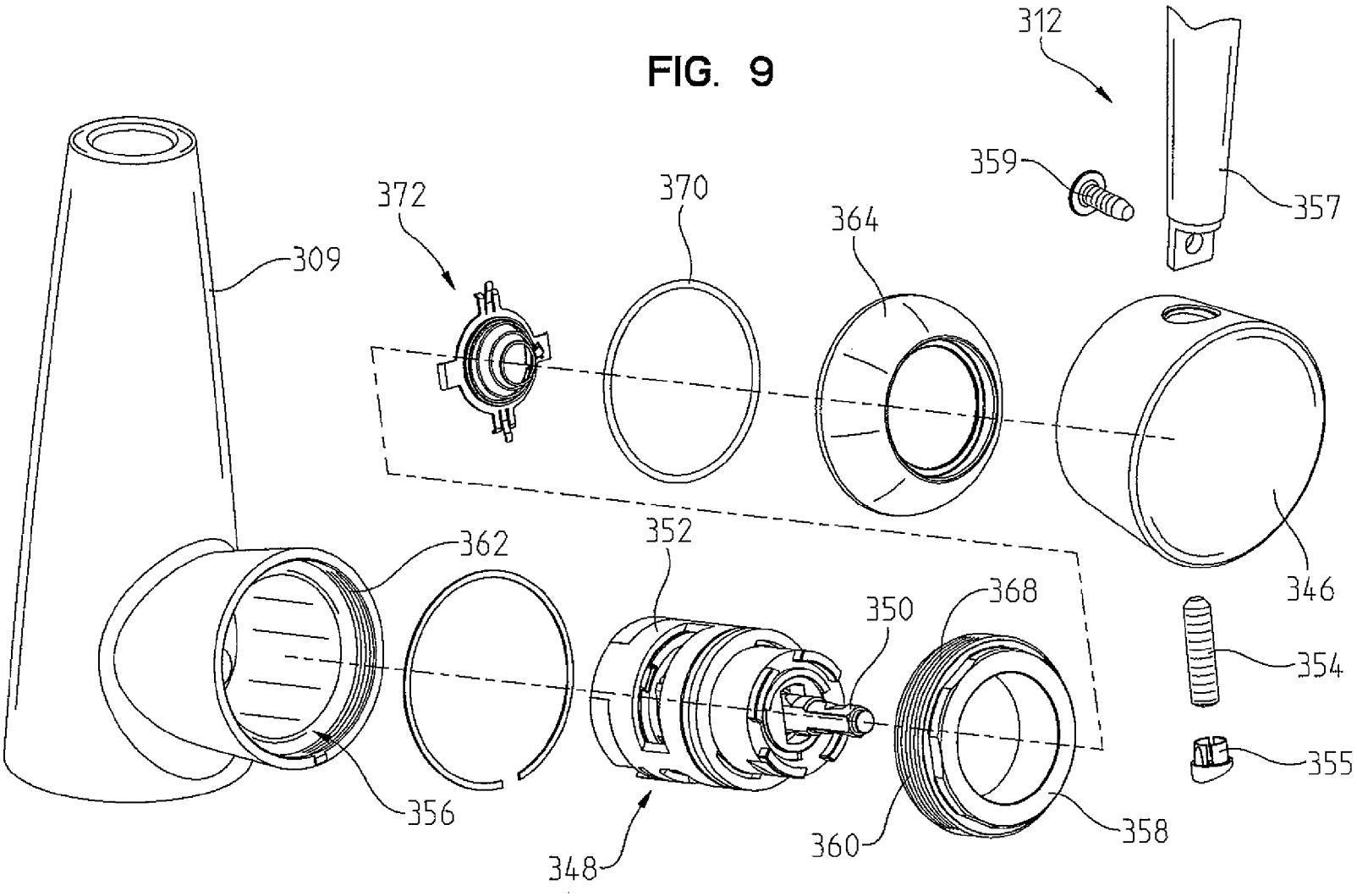
FIG. 9 is a partial exploded perspective view of the faucet of FIG. 7.
Figure 10:
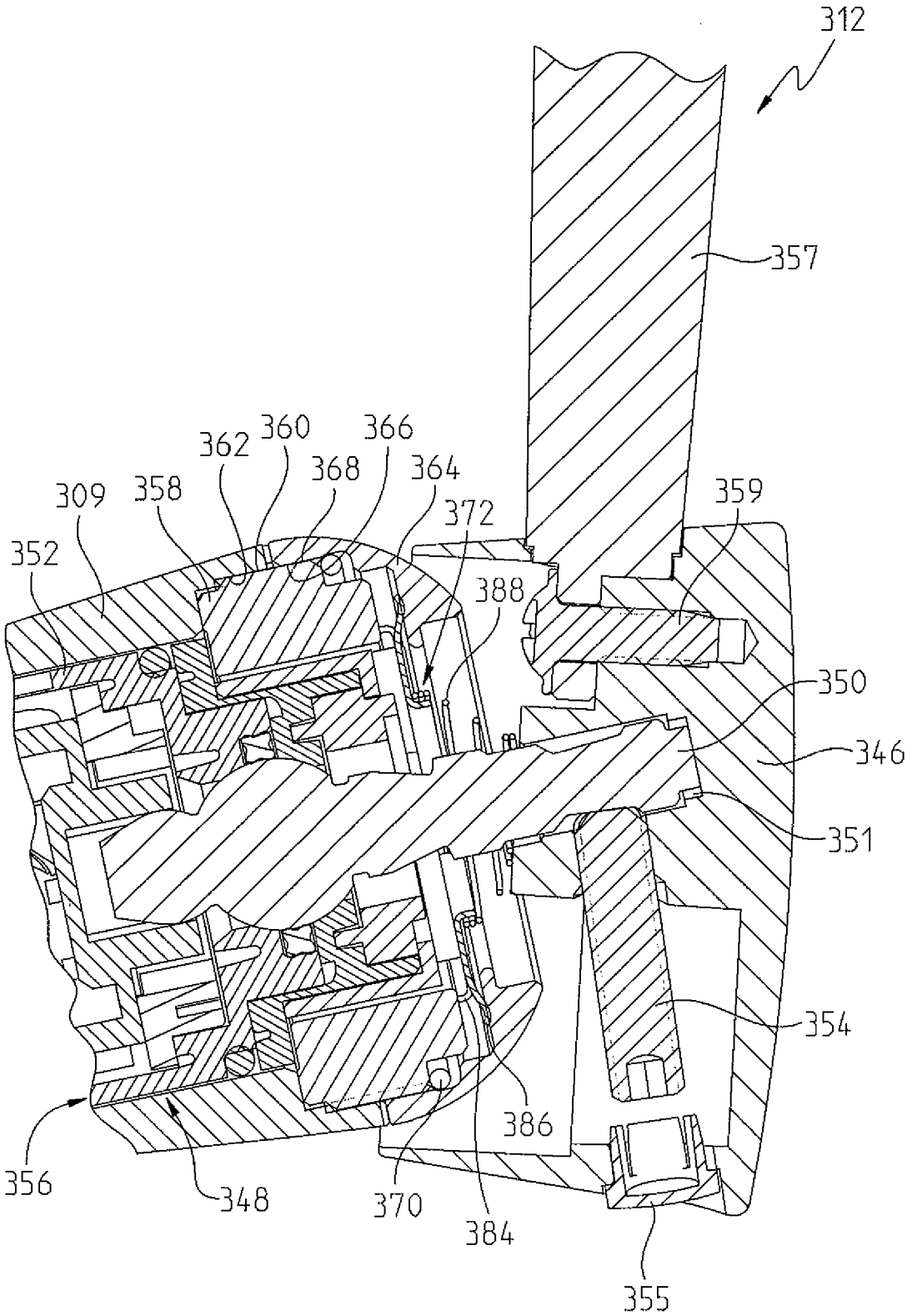
FIG. 10 is a partial cross-sectional view of the handle coupling of the faucet of FIG. 7 taken along 10-10.

With reference now to FIGS. 9 and 10, handle 312 includes a handle body 346 operably coupled to a manual valve cartridge 348. Handle body 346 is illustratively formed of an electrically conductive material, such as die cast zinc with a chrome plated or PVD finished surface. Valve cartridge 348 may be of conventional design and illustratively includes a valve stem 350 operably coupled to valve members (not shown) to control the flow of hot and cold water therethrough. In the illustrative embodiment, valve cartridge 348 includes a plastic housing 352 receiving the valve members, illustratively ceramic discs, and is therefore electrically non-conductive. Stem 350 is illustratively received with a receiving bore 351 of the body 346 and fixed thereto by a set screw 354. A plug 355 covers the opening for set screw 354. Stem 350 is illustratively formed of an electrically conductive material, illustratively a metal.

A user input member, illustratively a handle blade 357, is operably coupled to handle body 346. In one illustrative embodiment, a fastener, such as a screw 359, couples handle blade 357 to handle body 386.

Valve cartridge 348 is received within a valve receiving bore 356 formed within base 309 of hub 310. A bonnet nut 358 secures valve cartridge 348 within receiving bore 356. More particularly, external threads 360 engage internal threads 362 of the receiving bore 356. Bonnet nut 358 is illustratively formed of an electrically conductive material, such as brass. A bonnet 364 receives bonnet nut 358 and again is illustratively formed of an electrically conductive material, such as brass having a chrome plated or PVD finished outer surface. Bonnet 364 illustratively includes internal threads 366 which engage external threads 368 of bonnet nut 358. A seal, such as o-ring 370, is received intermediate bonnet nut 358 and bonnet 364.

Hot and cold water inlet tubes 363*a* and 363*b* are fluidly coupled to manual valve cartridge 348. Mixed water output from valve cartridge 348 is supplied to outlet tube 365, which is fluidly coupled to electrically operable valve 307.

Figure 11:
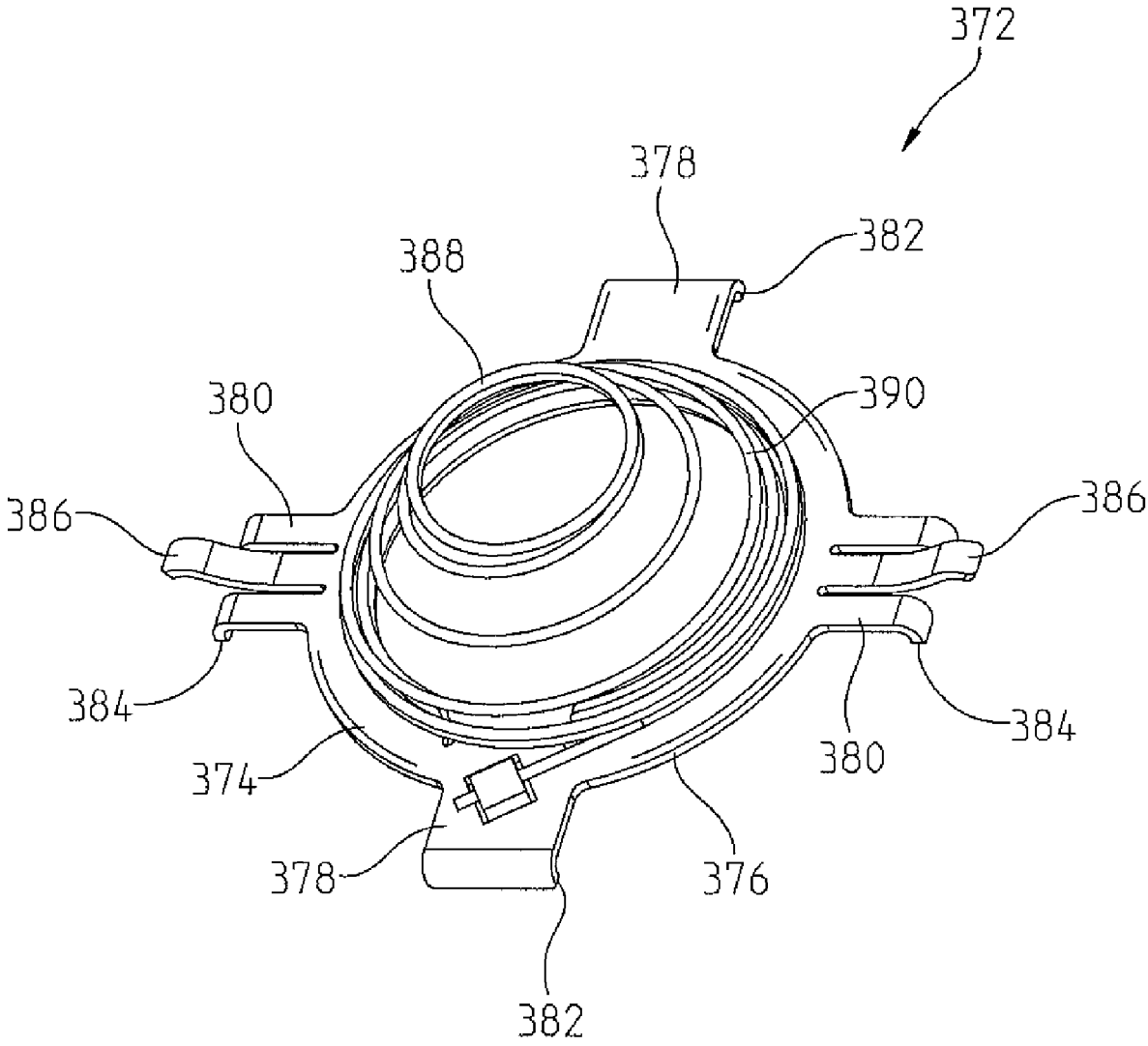
FIG. 11 is a perspective view of the contact assembly of FIG. 10.

With reference to FIGS. 9-11, a contact assembly 372 provides for an electrical connection between handle 312 and base 309 of hub 310. More particularly, contact assembly 372 is compressed between bonnet nut 358 and handle 312. Contact assembly 372 includes a support 374 including an annular ring or plate 376 and first and second pairs of diametrically opposed, radially outwardly extending tabs 378 and 380. Support 374 is formed of an electrically conductive material, illustratively stainless steel. First pair of tabs 378 include downwardly extending legs 382 which contact bonnet nut 358. Second pair of tabs 380 likewise include downwardly extending legs 384 which contact bonnet nut 358, and also include spring biased fingers 386 which contact bonnet 364.

Contact assembly 372 further includes a resilient contact member, illustratively a conical spring 388 coupled to and extending outwardly from support 374. Spring 388 includes an electrically conductive wire 390, illustratively formed of stainless steel. Valve stem 350 is concentrically received within spring 388 such that the wire 390 does not interfere with its movement. Spring 388 provides electrical communication between bonnet nut 358, bonnet 364 and body 346 of handle 312, while permitting movement of stem 350 relative to bonnet nut 358.

Figure 12:
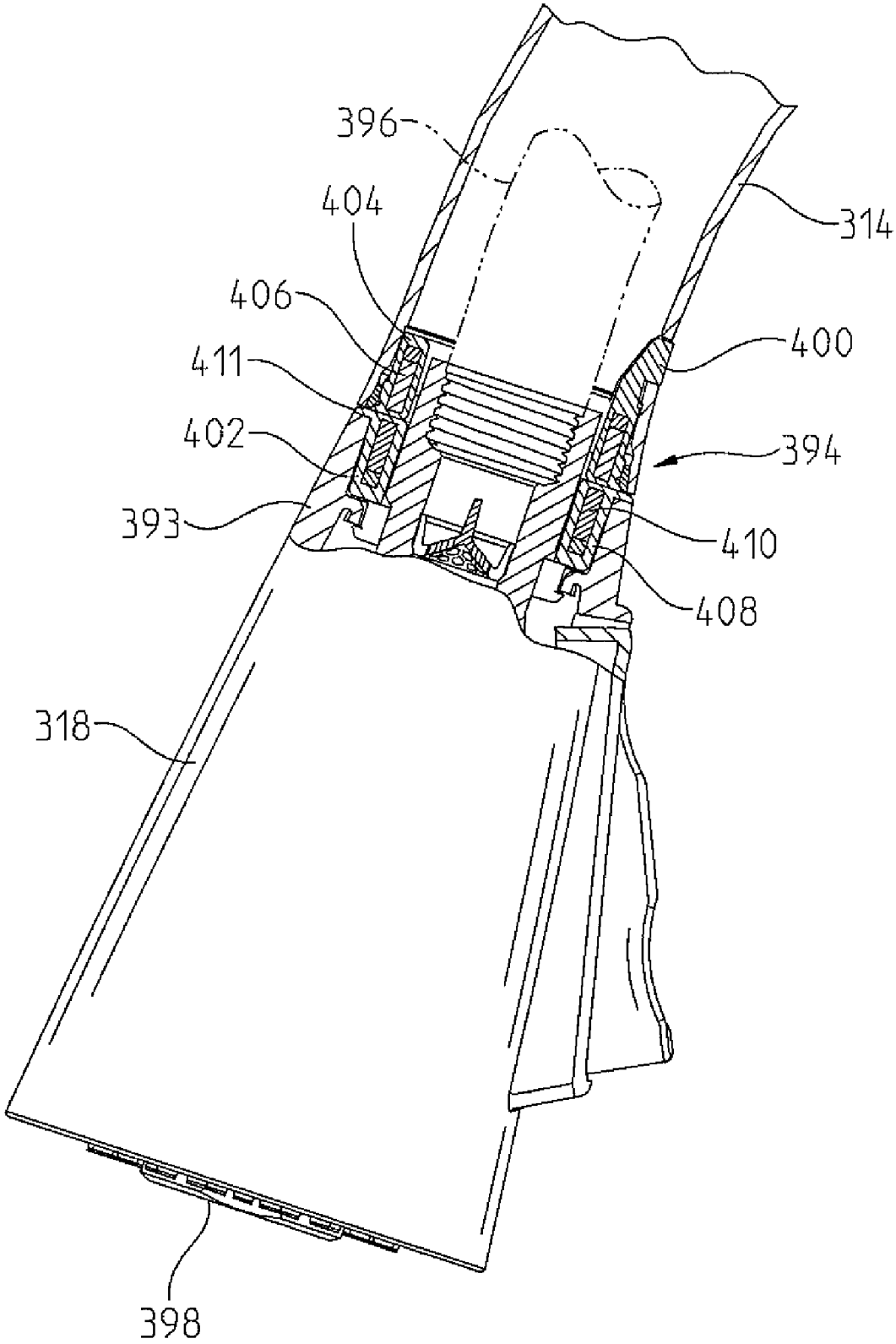
FIG. 12 is a side view, in partial cross-section, of the spray head coupled to the spout of FIG. 7.
Figure 13:
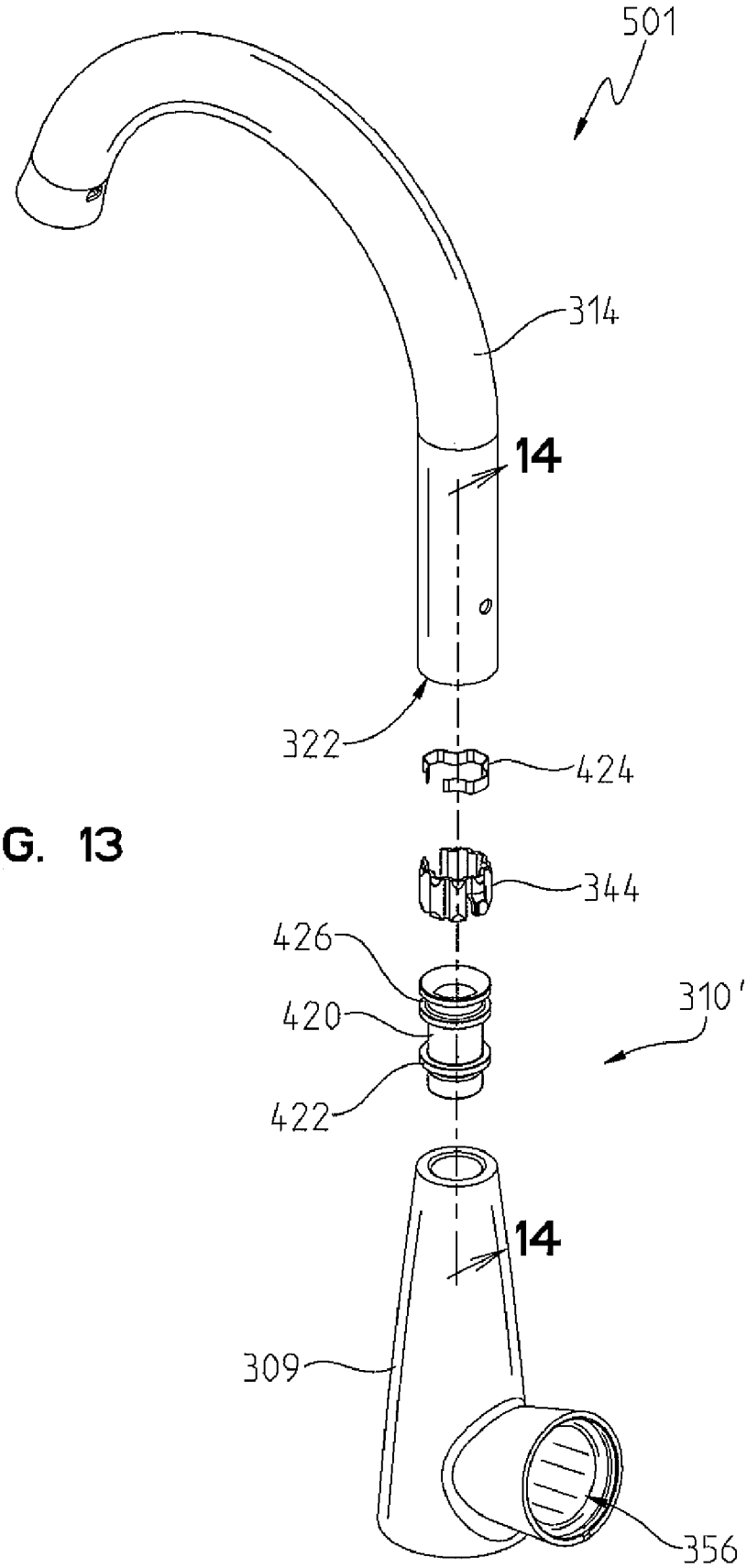
FIG. 13 is an exploded perspective view of a further illustrative embodiment spout coupling.
Figure 14:
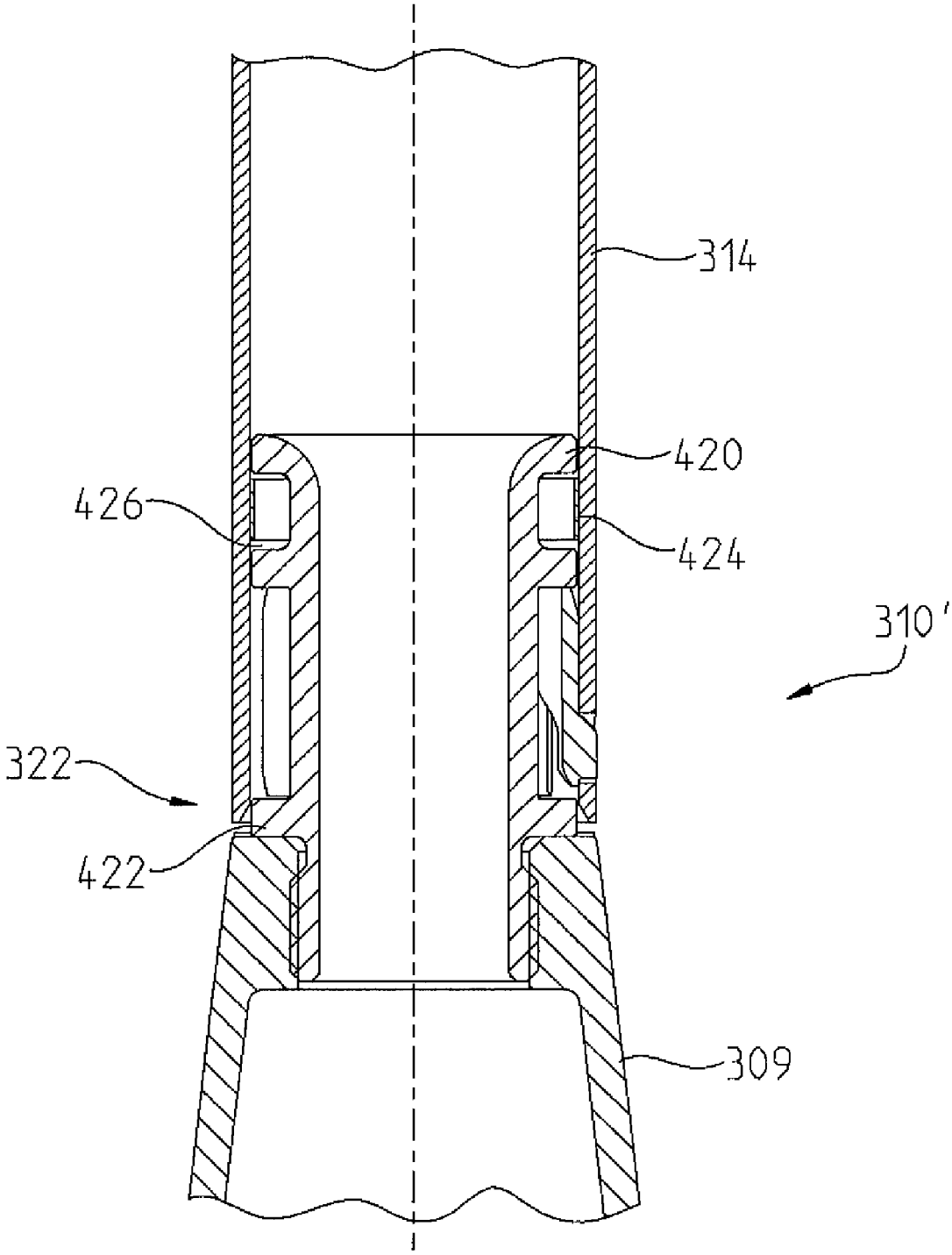
FIG. 14 is partial cross-sectional view of the spout coupling of FIG. 13 taken along lines 14-14.
Figure 15:
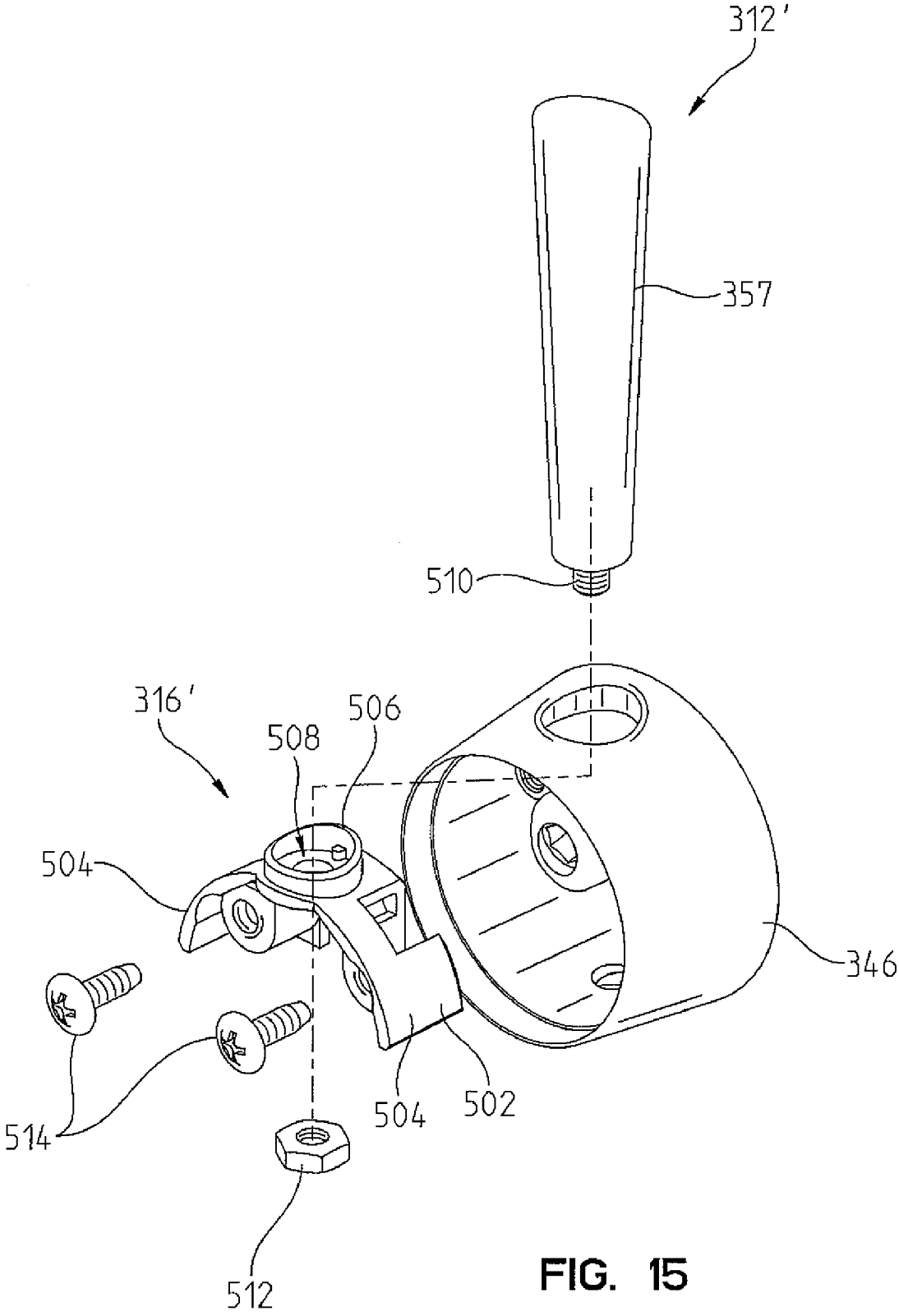
FIG. 15 is a partial exploded perspective view of a handle coupling for use in combination with the spout coupling of FIG. 13.
Figure 16:
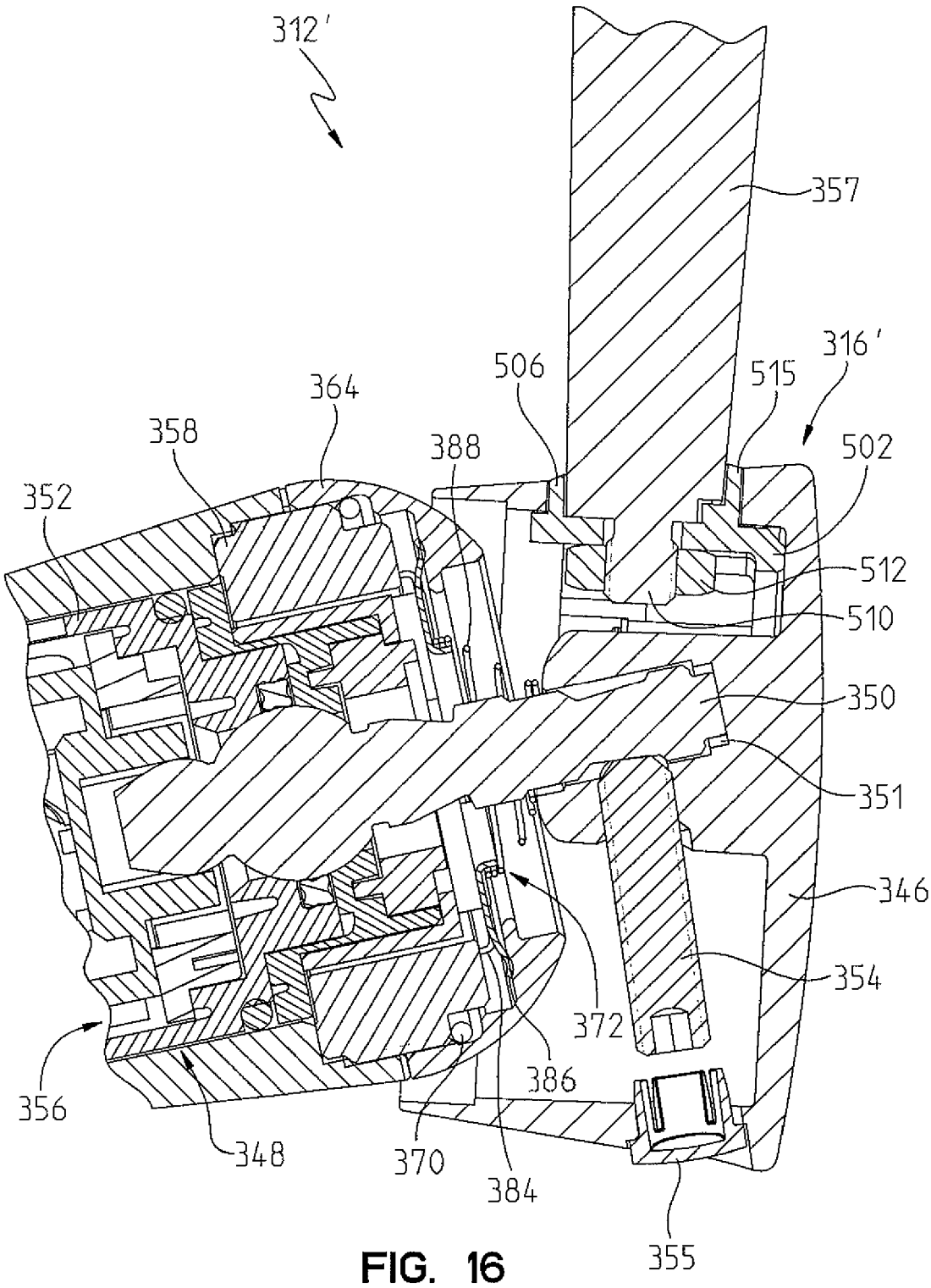
FIG. 16 is a cross-sectional view of the handle coupling of FIG. 15.

As noted above, pull-down spray head or wand 318 is releasably coupled to outlet end 392 of spout 314 (FIGS. 7 and 12). Spray head 318 illustratively includes a plated metal body 393. In one illustrative embodiment, a magnetic coupler 394 couples spray head 318 to spout 314. As is known, a flexible tube or hose 396 is fluidly coupled to spray head 318 and is received within spout 314. Hose 396 selectively supplies water from manual valve cartridge 348 and electrically operable valve 307 to an outlet 398 of spray head 318.

Spout portion 400 includes a body 404 supporting a magnet 406. Similarly, magnetic coupler 394 includes a spout portion 400 and a spray head portion 402. Spray head portion 402 includes a body 408 supporting a magnet 410. Body 408 illustratively includes a radially outwardly extending insulating flange 411 that electrically insulates the spray head body 393 from the spout 314. As such, user contact with spray head 318 is either not detected by sensor 300 or causes a nominal output signal shift and prevents undesired operation of the electrically operably valve 307. In an alternative embodiment, a direct electrical or an impedance coupling may be provided between spray head 318 and spout 314 such that user contact with the spray head 318 may be detected by sensor 300 to provide additional functionality.

With reference now to FIGS. 13-16, a further illustrative embodiment single hole mount faucet 501 is shown. Many of the components of faucet 501 are similar to those of faucet 301 detailed above. As such, similar components will be identified with like reference numbers.

In faucet 501, insulator 316' has been moved from intermediate hub 310' and spout 314, to intermediate handle blade 357 and handle body 346. An inner member 420 of hub 310' is illustratively concentrically received within lower end 322 of spout 314. Inner member 420 includes a lower contact ring 422 configured to electrically contact the upper end of hub base 309. A contact clip 424 is received within an annular groove 426 formed within an upper end of inner member 420. Contact clip 424 is formed of an electrically conductive material, illustratively spring steel, and facilitates electrical contact between hub 310' and spout 314.

As further detailed herein, capacitive coupling provides for touch differentiation between contact or touching of spout 314 and contact or touching of handle 312'. As shown in the illustrative embodiment of FIGS. 15 and 16, insulator 316' is in the form of an adaptor 502 positioned intermediate handle blade 357 and body 346. Adaptor 502 includes arcuate arms 504 extending from opposing sides of a receiving member 506. Receiving member 506 includes a bore 508 receiving an inner stem 510 of handle blade 357. A nut 512 threadably engages inner stem 510 to secure handle 312 to adapter 502. Adapter 502, in turn, is secured to handle body 346 through conventional fasteners, such as screws 514. Adapter 502 is formed of an electrically insulating material, illustratively a thermoplastic polyamide, such as DuPont Zytell 77G33.

Receiving member 506 includes a cylindrical wall 515 that defines a capacitive coupling between handle 312' and body 346. Hub 310' of faucet 501 acts as an electrode and energizes handle body 346 through contact assembly 372. Handle body 346 is capacitively coupled to handle 312 through the dialetric properties of adapter 502 and the adjacent air gap.

Figure 17:
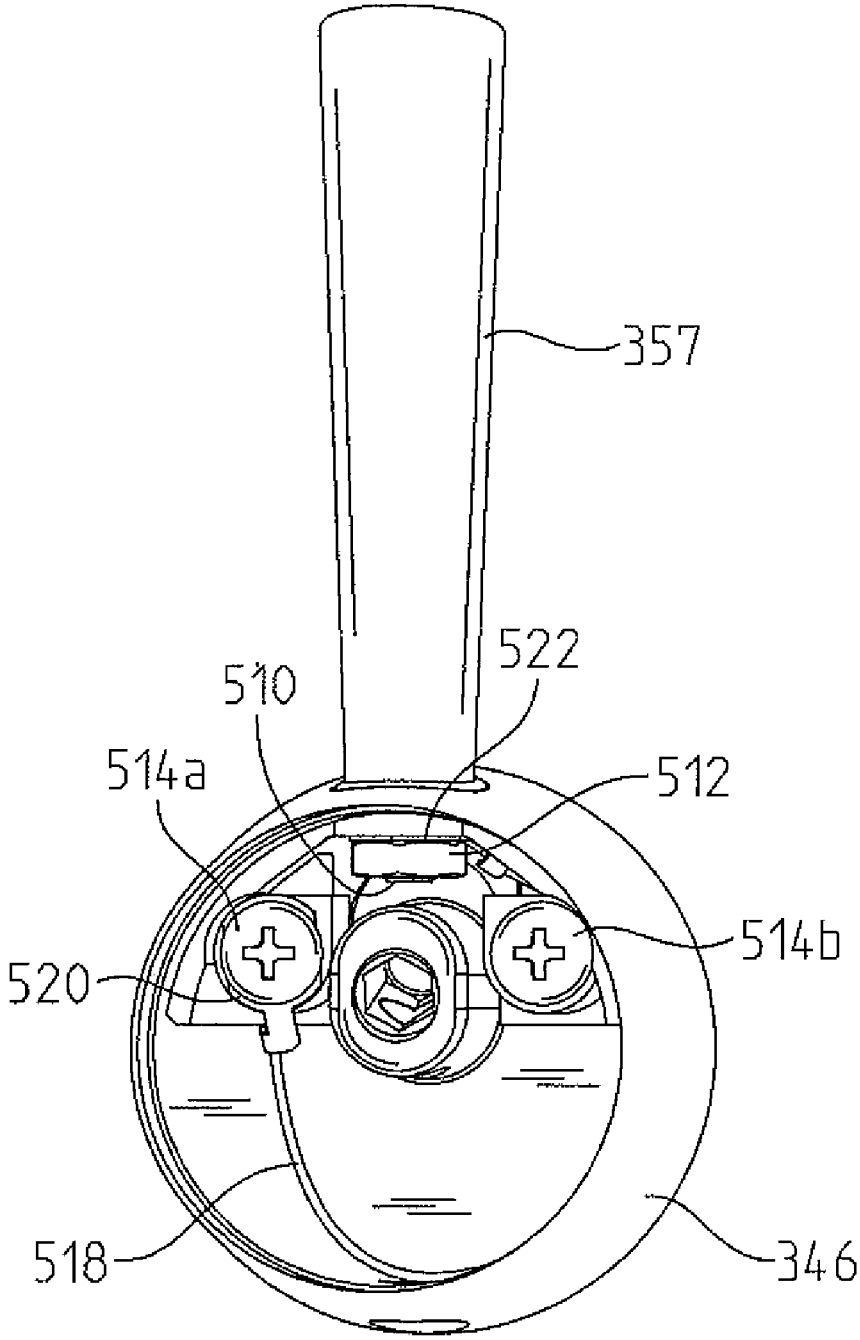
FIG. 17 is a rear plan view of a further illustrative embodiment spout coupling.

In a further illustrative embodiment, adapter 502 may be formed of a conductive material that will function as a resistor. As such, adapter 502 would lower the total impedance between the handle 312 and the handle body 346. Such an arrangement would provide a change in frequency shift or a capacitance change, such that a touch on the handle 312 may be differentiated from a touch on the hub 310 or handle body 346. In another illustrative embodiment as shown in FIG. 17, adapter 502 may function as an insulator, while a resistor wire 518 resistively couples handle blade 357 and body 346 for the purpose of touch differentiation. Illustratively, resistor wire 518 is a 24 AWG wire with a 1.5 kiliohm resistor. A first ring terminal end 520 is coupled to screw 514*a* while a second ring terminal end 522 is coupled to stem 510 of handle blade 357.

With reference to FIGS. 9-11, in another illustrative embodiment, contact assembly 372 may be formed of conductive material that will function as a resistor. For instance, support 374 may be formed of a carbon filed plastic, such that the handle 312 is resistively coupled to the hub 310. In yet another illustrative embodiment, a wire, with or without a resistor, my couple bonnet nut 358 to handle body 346.

In this application, the term "impedance coupling" is used to describe either a capacitive coupling or a resistive coupling as further described herein. In an illustrated embodiment, the impedance of the impedance coupling selected to match or approximate a characteristic impedance of a human body. Illustratively, a characteristic impedance of a human body is about a 1.5 K ohm resistance in series with about a 100 pF capacitance. The capacitive coupling is therefore set to about 100 pF by selecting the type of dielectric material, the thickness of the dielectric material, and controlling the air gap as discussed above. The resistive coupling is set at about 1.5 K ohms. By matching or approximating the characteristic impedance of a human body, the impedance coupling causes the frequency shift represented as an amplitude change to be reduced by about one half when the faucet component is touched. This drop in frequency shift permits the controller to determine whether the spout or the hub is touched, or whether the handle or the hub is touched, for example.

While the invention has been illustrated and described in detail in the drawings and foregoing description, the description is to be considered as illustrative and not restrictive in character. Only the preferred embodiments, and such alternative embodiments deemed helpful in further illuminating the preferred embodiment, have been shown and described. It will be appreciated that changes and modifications to the forgoing can be made without departing from the scope of the following claims.

The invention claimed is:

1. A faucet comprising:

a faucet body hub;

a manual valve handle movably coupled to the faucet body hub to control a manual valve, the manual valve handle being electrically coupled to the faucet body hub;

a spout coupled to the faucet body hub by an insulator so that the spout is electrically isolated from the faucet body hub;

a capacitive sensor having an electrode coupled to at least one of the faucet body hub and the manual valve handle; and a controller coupled to the capacitive sensor, the controller determining which of the manual valve handle and the spout is touched by a user based on an output signal from the capacitive sensor, and wherein a first output signal change is detected by the controller when the manual valve handle is touched by a user, and a second output signal change is detected by the controller when the spout is touched by a user, the first output signal change being greater than the second output signal change.

2. The faucet of claim 1, wherein the capacitive sensor is an oscillator having an input coupled to the electrode and an output coupled to the controller.

3. The faucet of claim 1, wherein the controller uses the output signal from the capacitive sensor to distinguish between when the manual valve handle is tapped by the user, when the manual valve handle is grabbed by the user, when the spout is tapped by the user, and when the spout is grabbed by the user to control operation of the faucet in different modes.

4. The faucet of claim 1, wherein the faucet comprises a single hole mount faucet.

5. The faucet of claim 1, wherein the insulator defines a capacitive coupling between the hub and the spout.

6. The faucet of claim 5, wherein the insulator includes a radially outwardly extending flange positioned intermediate a lower end of the spout and an upper end of the hub to reduce the effects of water droplets providing an electrical bridge therebetween.

7. A faucet comprising:

a faucet body hub;

a manual valve handle movably coupled to the faucet body hub to control a manual valve;

a contact assembly configured to electrically couple the manual valve handle to the faucet body hub, the contact assembly including a support and a resilient contact member movably coupled to the support to move along with the valve handle;

a spout coupled to the faucet body hub by an insulator so that the spout is electrically isolated from the faucet body hub;

a capacitive sensor having an electrode coupled to at least one of the faucet body hub and the manual valve handle; and a controller coupled to the capacitive sensor, the controller determining which of the manual valve handle and the spout is touched by a user based on an output signal from the capacitive sensor.

8. The faucet of claim 7, wherein the manual valve includes a movable valve stem, and the resilient contact member includes a spring receiving the stem.

9. A faucet comprising:

a faucet body hub;

a manual valve supported by the hub, the valve including a movable valve stem;

a manual valve handle movably supported by the hub and operably coupled to the valve stem to control the manual valve, the manual valve handle including a user input member;

a spout supported by the hub; and a capacitive coupling positioned intermediate the user input member of the handle and the spout.

10. The faucet of claim 9, further comprising:

a capacitive sensor coupled to the hub; and a controller operably coupled to the capacitive sensor, the controller determining which of the user input member of the manual valve handle and the spout is touched by a user based on an output signal from the capacitive sensor.

11. The faucet of claim 9, wherein the capacitive coupling is defined by an insulator positioned intermediate the hub and the spout.

12. The faucet of claim 11, wherein the hub includes a base and an upwardly extending inner member concentrically received within the spout, and the insulator includes a side wall positioned intermediate the inner member and the spout.

13. The faucet of claim 11, wherein the insulator includes a radially outwardly extending flange positioned intermediate a lower end of the spout and an upper end of the hub to reduce the effects of water droplets providing an electrical bridge therebetween.

14. The faucet of claim 9, wherein the capacitive coupling is defined by an insulator positioned intermediate the hub and the user input member of the handle.

15. The faucet of claim 9, wherein the capacitive sensor is an oscillator having an input coupled to the electrode and an output coupled to the controller.

16. The faucet of claim 9, wherein the controller uses the output signal from the capacitive sensor to distinguish between when the user input member of the handle is tapped by the user, when the user input member of the handle is grabbed by the user, when the spout is tapped by the user, and when the spout is grabbed by the user to control operation of the faucet in different modes.

17. The faucet of claim 9, wherein the faucet comprises a single hole mount faucet.

18. The faucet of claim 9, wherein a first output signal change is detected by the controller when the user input member of the handle is touched by a user, and a second output signal change is detected by the controller when the spout is touched by a user, the first output signal change being greater than the second output signal change.

19. The faucet of claim 9, wherein a contact assembly electrically couples the manual valve handle to the hub, the contact assembly including a support and a resilient contact member movably coupled to the support to move along with the valve handle.

20. The faucet of claim 19, wherein the resilient contact member includes a spring receiving the valve stem.

21. A faucet comprising:

a first component;

a second component;

an impedance coupling between the first component and the second component;

a sensor coupled to the first component; and a controller operably coupled to the sensor, the controller determining which of the first component and the second component is touched by a user based on an output signal from the sensor, wherein a first output signal change is detected by the controller when the first component is touched by the user, and a second output signal change is detected by the controller when the second component is touched by the user, the first output signal change being different than the second output signal change.

22. The faucet of claim 21, wherein the first component comprises a faucet body hub, and the second component comprises a spout coupled to the faucet body hub by an insulator.

23. The faucet of claim 21, wherein the first component comprises a faucet body hub, and the second component comprises a manual valve handle movably coupled to the faucet body hub to control a manual valve.

24. The faucet of claim 21, wherein the impedance coupling is a capacitive coupling.

25. The faucet of claim 24, wherein the capacitive coupling has a capacitance of 100 pF.

26. The faucet of claim 21, wherein the impedance coupling is a resistive coupling.

27. The faucet of claim 26, wherein the resistive coupling has a resistance of 1.5K ohms.

28. A method comprising:

determining a characteristic impedance of a human body;

coupling a first faucet component to a second faucet component with an impedance coupling having an impedance selected to approximate the characteristic impedance of a human body;

coupling a sensor to the first faucet component; and determining which of the first faucet component and the second faucet component is touched by a user based on an output signal from the sensor, wherein a first output signal change is detected when the first faucet component is touched by the user, and a second output signal change is detected when the second faucet component is touched by the user, the first output signal change being different than the second output signal change.

29. The method of claim 28, wherein the impedance coupling is a capacitive coupling.

30. The method of claim 29, wherein the capacitive coupling has a capacitance of 100 pF.

31. The method of claim 28, wherein the impedance coupling is a resistive coupling.

32. The method of claim 31, wherein the resistive coupling has a resistance of 1.5K ohms.

33. The method of claim 28, wherein the sensor is a capacitive sensor.

* * * * *